US011790853B2

(12) United States Patent
Jeong et al.

(10) Patent No.: US 11,790,853 B2
(45) Date of Patent: Oct. 17, 2023

(54) DISPLAY DEVICE

(71) Applicant: Samsung Display Co., LTD., Yongin-si (KR)

(72) Inventors: Min Jae Jeong, Hwaseong-si (KR); Hyun Joon Kim, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/147,534

(22) Filed: Jan. 13, 2021

(65) Prior Publication Data

US 2021/0295777 A1 Sep. 23, 2021

(30) Foreign Application Priority Data

Mar. 17, 2020 (KR) ..... 10-2020-0032679

(51) Int. Cl.
*G09G 3/3266* (2016.01)
*G09G 3/20* (2006.01)

(52) U.S. Cl.
CPC ..... *G09G 3/3266* (2013.01); *G09G 3/2003* (2013.01); *G09G 2310/0262* (2013.01); *G09G 2310/0289* (2013.01); *G09G 2330/12* (2013.01)

(58) Field of Classification Search
CPC ..... G09G 3/3266; G09G 3/2003; G09G 2310/0262; G09G 2310/0289; G09G 2330/12
See application file for complete search history.

(56) References Cited

U.S. PATENT DOCUMENTS

| | | | | |
|---|---|---|---|---|
| 10,861,386 | B2 * | 12/2020 | Park | G09G 3/3266 |
| 11,468,853 | B2 * | 10/2022 | Roh | G09G 3/3233 |
| 2014/0198136 | A1 * | 7/2014 | Lee | G09G 3/3233 345/690 |
| 2014/0354285 | A1 * | 12/2014 | Kim | G09G 3/3233 324/414 |
| 2014/0354286 | A1 * | 12/2014 | Kim | G09G 3/3225 324/414 |
| 2015/0106646 | A1 * | 4/2015 | Lee | G09G 3/3677 713/400 |
| 2016/0182042 | A1 * | 6/2016 | Kim | G11C 19/28 345/213 |
| 2016/0260367 | A1 * | 9/2016 | Kwak | G09G 3/006 |
| 2017/0052635 | A1 * | 2/2017 | Yu | G09G 3/3688 |
| 2017/0287396 | A1 * | 10/2017 | Akimoto | G09G 3/3233 |
| 2017/0337877 | A1 * | 11/2017 | Kim | G09G 3/3233 |
| 2017/0352311 | A1 * | 12/2017 | Lee | G09G 3/3648 |

(Continued)

FOREIGN PATENT DOCUMENTS

| | | | |
|---|---|---|---|
| KR | 100898675 | B1 | 5/2009 |
| KR | 101015312 | B1 | 2/2011 |

(Continued)

*Primary Examiner* — Kenneth Bukowski
(74) *Attorney, Agent, or Firm* — CANTOR COLBURN LLP

(57) ABSTRACT

A display device includes: a plurality of first pixels connected to first scan lines and a first data line, a plurality of second pixels connected to second scan lines and the first data line, a plurality of third pixels connected to the first scan lines or the second scan lines and a second data line, and a scan driver including a plurality of stages which supplies scan signals to one of the first scan lines and the second scan lines.

18 Claims, 22 Drawing Sheets

(56) References Cited

U.S. PATENT DOCUMENTS

| | | | | |
|---|---|---|---|---|
| 2018/0122304 | A1* | 5/2018 | Kim | G09G 3/3258 |
| 2018/0182274 | A1* | 6/2018 | Jung | G09G 3/006 |
| 2018/0350300 | A1* | 12/2018 | Park | G09G 3/3266 |
| 2019/0043421 | A1* | 2/2019 | Yang | G09G 3/3291 |
| 2019/0073931 | A1* | 3/2019 | Kim | G09G 3/006 |
| 2019/0096978 | A1* | 3/2019 | Jung | G09G 3/3225 |
| 2019/0180683 | A1* | 6/2019 | Lee | G09G 3/3208 |
| 2021/0248938 | A1* | 8/2021 | Lee | G09G 3/006 |

FOREIGN PATENT DOCUMENTS

| | | | |
|---|---|---|---|
| KR | 101992892 | B1 | 6/2019 |
| KR | 1020190074022 | A | 6/2019 |

* cited by examiner

DISPLAY DEVICE

This application claims priority to Korean Patent Application No. 10-2020-0032679, filed on Mar. 17, 2020, and all the benefits accruing therefrom under 35 U.S.C. § 119, the content of which in its entirety is herein incorporated by reference.

BACKGROUND

1. Field

Embodiments of the invention relate to a display device.

2. Description of the Related Art

With the development of information society, display devices for displaying images have been used in various fields. For example, such display devices are applied to various electronic appliances such as smart phones, digital cameras, notebook computers, navigators, and smart televisions. A display device may be a flat panel display device such as a liquid crystal display device, a field emission display device, or a light emitting display device. Since the light emitting display device, among flat panel display devices, includes light emitting elements by which each of the pixels in a display panel emits light by itself, the light emitting display device may display an image without using a backlight unit for providing light to a display panel.

A display device typically includes a display panel including data lines, scan lines, and pixels connected to the data lines and the scan lines, a data driver for supplying data signals to the data lines, and a scan driver including a shift register for supplying scan signals to the scan lines.

SUMMARY

In a display device, pixels that emit light of different colors from each other may be connected to a same data line. In such a display device, a lighting voltage may be applied to each of the pixels connected to the same data line for light inspection of the pixels, and the charging rate of the data line may decrease as the resolution of the display device increases.

Embodiments of the invention are to provide a display device in which a lighting voltage may be supplied to each of a plurality of pixels connected to one data line and emitting light of different colors from each other, and the reduction in charging rate of the data line may be prevented to efficiently inspect the lighting of each of the pixels.

According to an embodiment of the disclosure, a display device includes: a plurality of first pixels connected to a plurality of first scan lines and a first data line, a plurality of second pixels connected to a plurality of second scan lines and the first data line, a plurality of third pixels connected to the first scan lines or the second scan lines and a second data line, and a scan driver including a plurality of stages which supplies scan signals to one of the first scan lines and the second scan lines.

In an embodiment, the stages may include: first stages sequentially which supplies the scan signals to each of the first scan lines based on a first start signal, and second stages sequentially which supplies the scan signals to each of the second scan lines based on a second start signal.

In an embodiment, the first stages may include: a first-first stage which outputs a first-first scan signal based on the first start signal, and a second-first stage which outputs a second-first scan signal based on the first-first scan signal.

In an embodiment, the second stages may include: a first-second stage which outputs a first-second scan signal based on the second start signal, and a second-second stage which outputs a second-second scan signal based on the first-second scan signal.

In an embodiment, the display device may further include: a first test transistor which supplies a first lighting voltage to the first data line based on a test gate signal, and a second test transistor which supplies a second lighting voltage to the second data line based on the test gate signal.

In an embodiment, when the first lighting voltage has a first voltage level which turns on the first pixels or the second pixels, the second lighting voltage may have a second voltage level which turns off the first pixels or the second pixels.

In an embodiment, the stages may include: a plurality of first stages sequentially which supplies scan signals to each of the first scan lines when a start signal is supplied during a first period, and a plurality of second stages sequentially which supplies scan signals to each of the second scan lines when the start signal is supplied during a second period different from the first period.

In an embodiment, the first stages may include: a first-first stage which outputs a first-first scan signal when the start signal is supplied during the first period, and a second-first stage which outputs a second-first scan signal based on the first-first scan signal.

In an embodiment, the second stages may include: a first-second stage which outputs a first-second scan signal when the start signal is supplied during the second period, and a second-second stage which outputs a second-second scan signal based on the first-second scan signal.

In an embodiment, the first pixels may be connected to the second scan lines and a third data line, the second pixels may be connected to the first scan lines and the third data line, and the f third pixels may be connected to the first scan lines or the second scan lines and a fourth data line.

In an embodiment, the display device may further include: a first test transistor which supplies a first lighting voltage to the first data line based on a first test gate signal, and a second test transistor which supplies the first lighting voltage to the third data line based on a second test gate signal.

In an embodiment, the display device may further include: a third test transistor which supplies a third lighting voltage to the third data line based on the first test gate signal, and a fourth test transistor which supplies the third lighting voltage to the first data line based on the second test gate signal.

In an embodiment, when the first lighting voltage has a first voltage level which turns on the first pixels or the plurality of second pixels, the third lighting voltage may have a second voltage level which turns off the first pixels or the plurality of second pixels.

In an embodiment, when the third lighting voltage has a first voltage level which turns on the first pixels or the second pixels, the first lighting voltage may have a second voltage level which turns off the first pixels or the plurality of second pixels.

In an embodiment, the display device may further include: a fifth test transistor which supplies a second lighting voltage to the second data line based on a third test gate signal, and a sixth test transistor which supplies the second lighting voltage to a fourth data line based on the third test gate signal.

In an embodiment, The plurality of first pixels may be connected to the second scan lines and a third data line, the plurality of second pixels may be connected to the first scan lines and the third data line, and the plurality of third pixels may be connected to the first scan lines or the second scan lines and a fourth data line.

In an embodiment, the display device may further include: a first test transistor which supplies a first lighting voltage to the first data line based on a first test gate signal, and a second test transistor which supplies the first lighting voltage to the third data line based on a second test gate signal.

In an embodiment, the display device may further include: a third test transistor which supplies a third lighting voltage to the third data line based on the first test gate signal, and a fourth test transistor which supplies the third lighting voltage to the first data line based on the second test gate signal.

In an embodiment, when the first lighting voltage has a first voltage level which turns on the first pixels or the plurality of second pixels, the third lighting voltage may have a second voltage level which turns off the first pixels or the plurality of second pixels.

In an embodiment, the display device may further include: a fifth test transistor which supplies a second lighting voltage to the second data line based on a third test gate signal, and a sixth test transistor which supplies the second lighting voltage to the fourth data line based on the third test gate signal.

BRIEF DESCRIPTION OF THE DRAWINGS

The above and other features of the invention will become more apparent by describing in detail embodiments thereof with reference to the accompanying drawings, in which.

DETAILED DESCRIPTION

Figure 1:
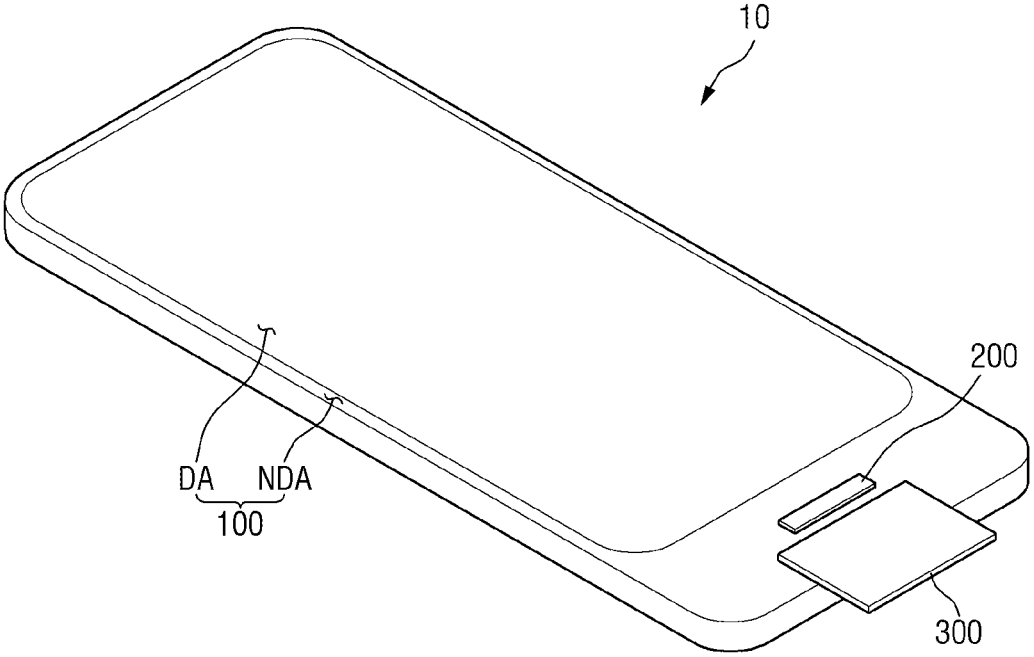
FIG. 1 is a perspective view of a display device according to an embodiment.

The invention will be described more fully hereinafter with reference to the accompanying drawings, in which various embodiments are shown. As those skilled in the art would realize, the described embodiments may be modified in various different ways, all without departing from the spirit or scope of the present disclosure.

Parts that are irrelevant to the description will be omitted to clearly describe the present disclosure, and like reference numerals designate like elements throughout the specification.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the X-axis, the Y-axis, and the Z-axis are not limited to three axes of a rectangular coordinate system, such as the x, y, and z axes, and may be interpreted in a broader sense. For example, the X-axis, the Y-axis, and the Z-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various embodiments are described herein with reference to sectional and/or exploded illustrations that are schematic illustrations of idealized embodiments and/or intermediate structures. As such, variations from the shapes of the illustrations as a result, for example, of manufacturing techniques and/or tolerances, are to be expected. Thus, embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments of the invention will be described in detail with reference to the accompanying drawings.

Figure 2:
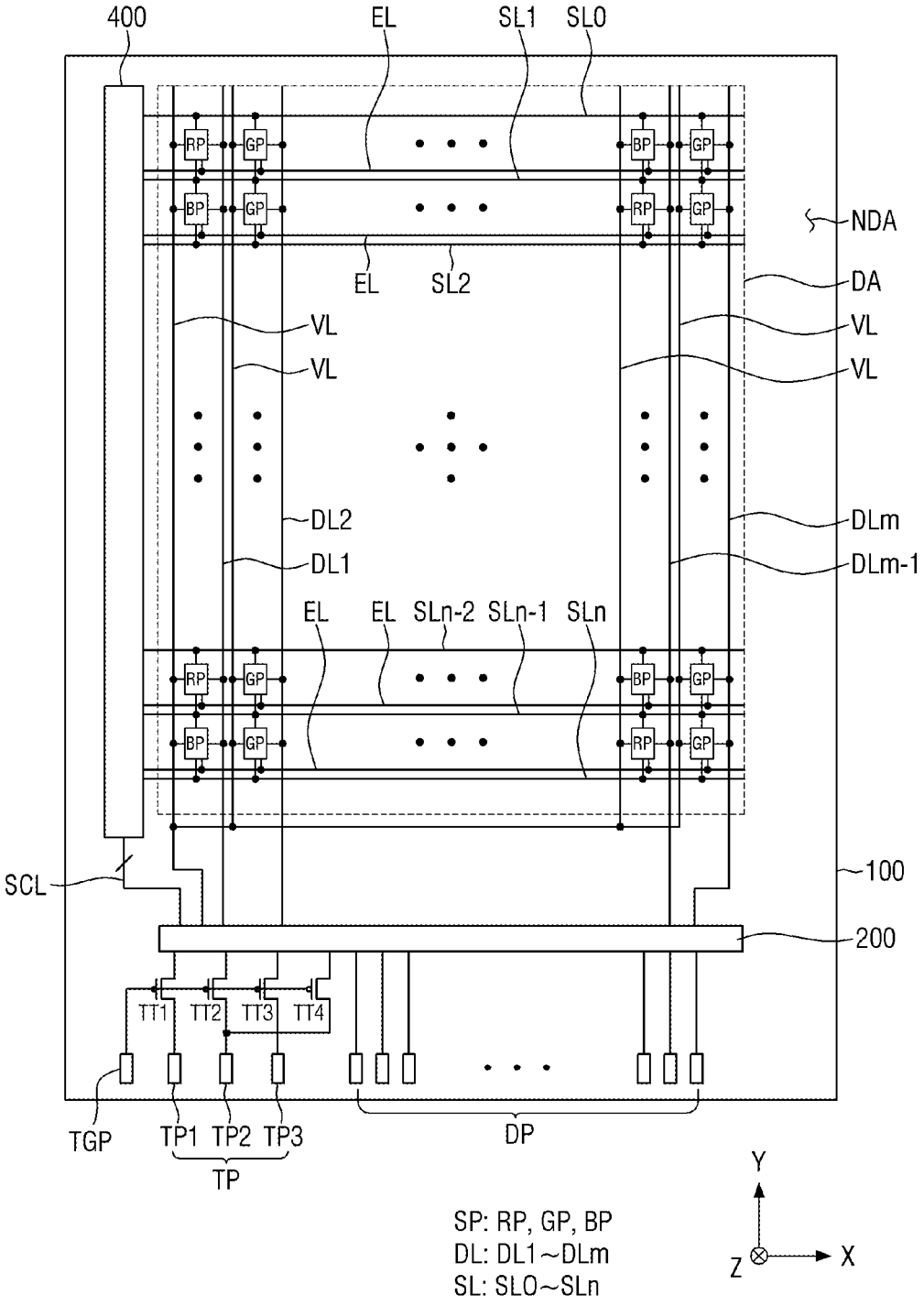
FIG. 2 is a plan view of a display device according to an embodiment.
Figure 3:
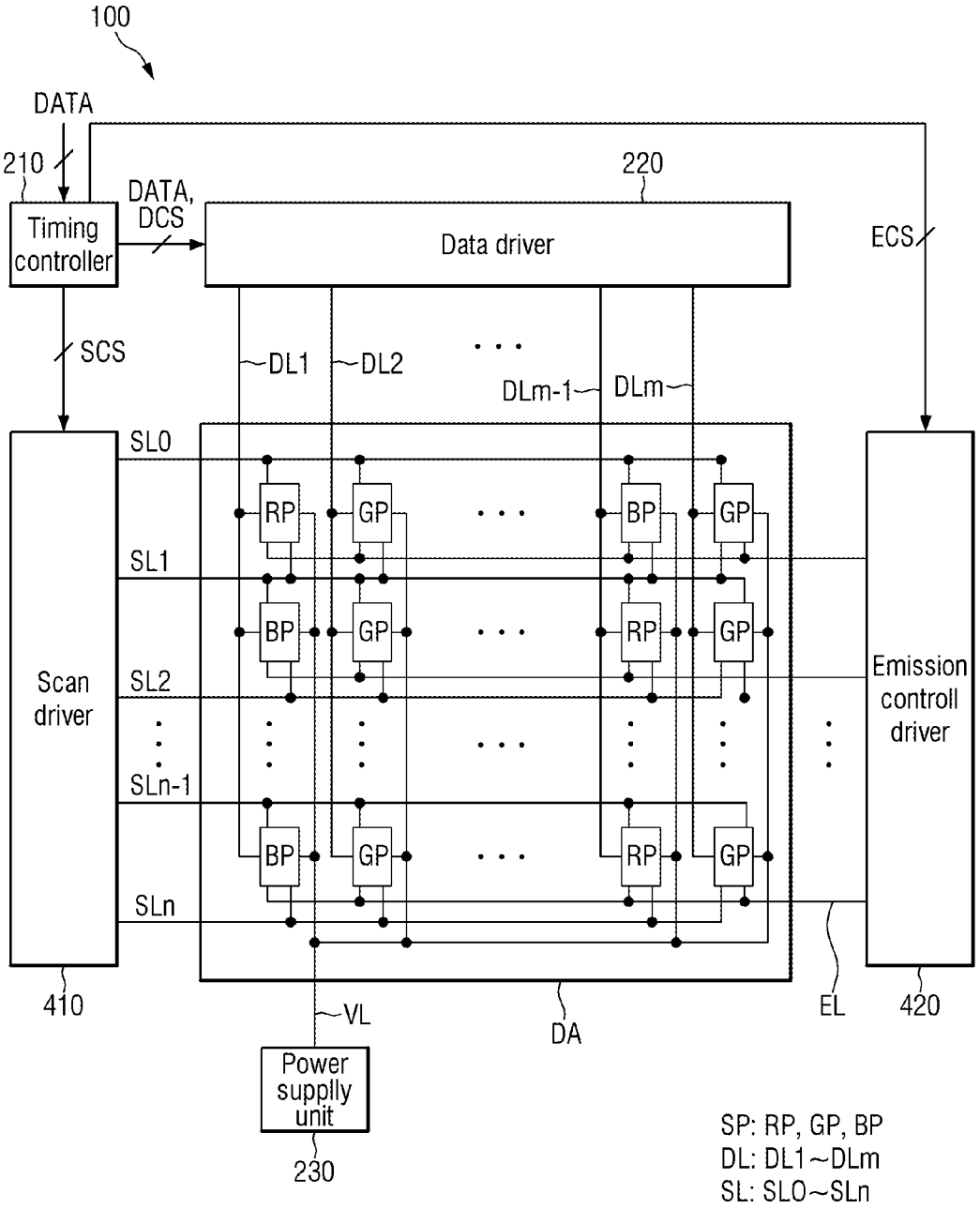
FIG. 3 is a block diagram of a display device according to an embodiment.

FIG. 1 is a perspective view of a display device according to an embodiment, FIG. 2 is a plan view of a display device according to an embodiment, and FIG. 3 is a block diagram of a display device according to an embodiment.

In this specification, the "on", "over", "top", "upper side", or "upper surface" refers to an upward direction with respect to the display device 10, that is, a Z-axis direction, and the "beneath", "under", "bottom", "lower side", or "lower surface" refers to a downward direction with respect to the display device 10, that is, a direction opposite to the Z-axis direction. Further, the "left", "right", "upper", and "lower" refer to directions when the display device 10 is viewed from the plane. For example, the "left" refers to a direction opposite to the X-axis direction, the "right" refers to the X-axis direction, the "upper" refers to the Z-axis direction, and the "lower" refers to a direction opposite to the Z-axis direction.

Referring to FIGS. 1 to 3, an embodiment of the display device 10, which is a device for displaying a moving image or a still image, may a device including a display screen such as televisions, laptop or notebook computers, monitors, billboards, internet of things ("IOTs") as well as portable electronic appliances such as mobile phones, smart phones, tablet personal computers ("PC"s), smart watches, watch phones, mobile communication terminals, electronic notebooks, electronic books, portable multimedia players ("PMP"s), navigators, and ultra mobile PCs ("UMPC"s).

The display device 10 may be an light emitting display device such as an organic light emitting display device including an organic light emitting diode, a quantum dot light emitting display device including a quantum dot light emitting layer, an inorganic light emitting display device including an inorganic semiconductor, or a micro light emitting display device using a micro light emitting diode. Hereinafter, for convenience of description, embodiments where the display device 10 is an organic light emitting display device will be described, but the invention is not limited thereto.

An embodiment of the display device 10 may include a display panel 100, a display driver 200, and a circuit board 300.

The display panel 100 may have a rectangular planar shape having short sides in the first direction (X-axis direction) and long sides in the second direction (Y-axis direction) intersecting the first direction (X-axis direction). The corner where the short side in the first direction (X-axis direction) meets the long side in the second direction (Y-axis direction) may have a right angle shape or a round shape with a predetermined curvature. The planar shape of the display panel 100 is not limited to a rectangular shape, and may be variously modified to be in another polygonal shape, circular shape, or elliptical shape. The display panel 100 may be flat, but the shape thereof is not limited thereto. The display panel 100 may include a curved portion at the left and right ends thereof and having a constant curvature or a variable curvature. The display panel 100 may be flexibly formed to be warped, bent, folded, or rolled.

The display panel 100 may include a display area DA in which pixels PX are disposed to display an image, and a non-display area NDA that is a peripheral area of the display area DA. The display area DA may include pixels SP, scan lines SL connected to the pixels SP, emission control lines EL, data lines DL, and a voltage supply line VL. The scan lines SL and the emission control lines EML may be arranged in parallel in the first direction. The data lines DL and the voltage supply line VL may be arranged in parallel in the second direction crossing the first direction.

Each of the pixels PX may be connected to a corresponding scan line SL, a corresponding data line DL, a corresponding emission control line EL, and a corresponding voltage supply line VL. FIG. 2 an embodiment where each of the pixels PX is connected to two scan lines SL, one data line DL, one emission control line EL, and the voltage supply line VL, but the invention is not limited thereto. In one alternative embodiment, for example, each of the pixels PX may be connected to three scan lines SL.

The pixels SP may include first to third pixels RP, BP, and GP. The first pixel RP may be connected to a first data line DL1 and a first scan line SL1. The second pixel BP may be connected to the first data line DL1 and a second scan line SL2. The first and second pixels RP and BP may be connected to a same data line DL, and may be connected to different scan lines SL from each other. The first pixels RP may be arranged in an odd row to be connected to scan lines SL1, SL3, . . . , SL (n−1) of an odd row (n is a multiple of 2), and the second pixels BP may be arranged in an even row to be connected to scan lines SL2, SL4, . . . , SLn in an even row. The first and second pixels RP and BP are not limited to those shown in FIG. 2, and may be alternately arranged along a same data line DL. In one embodiment, for example, the scan driver 400 may perform the lighting inspection of the first pixel RP by supplying scan signals to some of the plurality of scan lines SL. In one alternative embodiment, for example, the scan driver 400 may perform the lighting inspection of the second pixel BP by supplying scan signals to others of the plurality of scan lines SL.

The third pixel GP may be connected between a corresponding scan line of the plurality of scan lines SL and a second data line DL2. The third pixels GP may be arranged along a same data line DL. In one embodiment, for example, the first and second pixels RP and BP may be connected to odd-numbered data lines DL1, DL3, . . . , DL (m−1) (m is a multiple of 2), and the third pixels GP may be connected to even-numbered data lines DL2, DL4, . . . , DLm.

Each of the pixels SP may include a driving transistor, a switching transistor, a light emitting element, and a capacitor. The switching transistor may be turned on when a scan signal is applied from the scan line SL, and thus a data voltage of the data line DL may be applied to a gate electrode of the driving transistor. The driving transistor may supply a driving current to the light emitting element based on the data voltage applied to the gate electrode, and the light emitting element may emit light having a predetermined luminance corresponding to the intensity of the driving current. In one embodiment, for example, the driving transistor and the switching transistor may be thin film transistors. The light emitting element may be an organic light emitting diode including a first electrode, an organic light emitting layer, and a second electrode. The capacitor may maintain the data voltage applied to the gate electrode of the driving transistor to be constant.

The non-display area NDA may be defined as an area from the display area DA to the edge of the display panel 100. The non-display area NDA may further include a scan driver 400 for applying scan signals to the scan lines SL, fan-out lines between the data lines DL and the display driver 200, pads DP connected to the display driver 200 to supply a data voltage, test pads TP for supplying a lighting voltage, and a test gate pad TGP for supplying a test gate signal.

In one embodiment, for example, the display driver 200 may be disposed at a side of the display panel 100, and the pads DP, the test pads TP and the test gate pad TGP may be arranged at an edge portion of the display panel 100. The pads DP, the test pads TP and the test gate pad TGP may be arranged closer to an edge of the display panel 100 than the display driver 200 is.

The test pads TP may include first to third test pads TP1, TP2, and TP3. The first to third test pads TP1, TP2, and TP3 may receive first to third lighting voltages, respectively. Each of the first to third lighting voltages may be a gray voltage that turns on the pixels SP or a black voltage that turns off the pixels SP. Each of the first to third lighting voltages may be a DC voltage, but is not limited thereto. In one embodiment, for example, the first to third test pads TP1, TP2, and TP3 may be connected to a lighting device or a power supply device, and may receive the first to third lighting voltages.

The non-display area NDA may further include test transistors connected between the test pads TP and the display driver 200. The test transistors may include first to fourth test transistors TT1 to TT4. The first test transistor TT1 may be connected between the first test pad TP1 and the first data line DL1, and the second test transistor TT2 may be connected between the second test pad TP2 and the second data line DL2. The third test transistor TT3 may be connected between the third test pad TP3 and the third data line DL3, and the fourth test transistor TT4 may be connected between the second test pad TP2 and the fourth data line DL4. Each of the first to fourth test transistors TT1 to TT4 may be connected between a corresponding test pad of the test pads TP and a corresponding data line DL of the plurality of data lines DL, thereby selectively supplying the first to third lighting voltages to the plurality of data lines. In one embodiment, for example, each of the first to fourth test transistors TT1 to TT4 may receive a same test gate signal to be turned on or off at the same time.

The test gate pad TGP may receive a test gate signal, and may be connected to the gate electrode of each of the first to fourth test transistors TT1 to TT4. In one embodiment, for example, the test gate pad TGP may be connected to a lighting device, and may receive test gate signals that turn on the first to fourth test transistors TT1 to TT4 from the lighting device.

The scan driver 400 may be connected to the display driver 200 through a plurality of scan control lines SCL. The scan driver 400 may receive scan control signals SCS and emission control signals ECS from the display driver 200 through the plurality of scan control lines SCL.

In an embodiment, as shown in FIG. 3, the scan driver 400 may include a scan driving circuit 410 and an emission control driving circuit 420.

The scan driving circuit 410 may generate scan signals based on the scan control signal SCS, and may sequentially output the scan signals to the scan lines SL. The emission control driving circuit 420 may generate emission control signals corresponding to the emission control signal ECS from the display driver 200, and may sequentially output the emission control signals to the emission control lines EL.

The scan driver 400 may include a plurality of thin film transistors. The scan driver 400 may be formed in the same layer as the thin film transistors of the pixels PX. In an embodiment, as shown in FIG. 2, the scan driver 400 is formed in the non-display area NDA located at one side, for example, left side of the display area DA, but the invention is not limited thereto. In one alternative embodiment, for example, the scan driver 400 may be formed in the non-display area NDA located at both opposing sides, e.g., left and right sides of the display area DA.

In an embodiment, as shown in FIG. 3, the display driver 200 may include a timing controller 210, a data driver 220, and a power supply unit 230.

The timing controller 210 may receive digital video data DATA and timing signals from a circuit board 300. The timing controller 210 may generate a data control signal DCS for controlling the operation timing of the data driver 220 based on the timing signals, may generate a scan control signal SCS for controlling the operation timing of the scan driving circuit 410 based on the timing signals, and may generate an emission control signal ECS for controlling the operation timing of the emission control driving circuit 420 based on the timing signals. The timing controller 210 may supply the digital video data DATA and the data control signal DCS to the data driver 220. The timing controller 210 may supply the scan control signal SCS to the scan driving circuit 410 through the plurality of scan control lines SCL, and may supply the emission control signal ECS to the emission control driving circuit 420.

The data driver 220 may convert the digital video data DATA into analog data voltages and supply the analog data voltages to the data lines DL through the fan-out lines. The scan signals of the scan driver 400 may select pixels SP to which the data voltage is to be supplied, and the data driver 220 may supply the data voltage to the selected pixels SP.

The power supply unit 230 may generate a first driving voltage and supply the first driving voltage to the voltage supply line VL. The power supply unit 230 may generate a second driving voltage and supply the second driving voltage to a cathode electrode of the light emitting element of each of the pixels PX. Here, the first driving voltage may be a high-potential voltage for driving the light emitting element, and the second driving voltage may be a low-potential voltage for driving the light emitting element. That is, the first driving voltage may have a higher potential than the second driving voltage.

In an embodiment, the display driver 200 is formed as an integrated circuit ("IC"), and may be attached onto the display panel 100 by a chip on glass ("COG") method, a chip on plastic ("COP") method, or an ultrasonic bonding method. However, the invention is not limited thereto. In one alternative embodiment, for example, the display driver 200 may be attached onto the circuit board 300.

The circuit board 300 may be attached onto the pads DP using an anisotropic conductive film. Thus, lead lines of the circuit board 300 may be electrically connected to the pads DP. The circuit board 300 may be a flexible printed circuit board, a printed circuit board, or a flexible film such as a chip on film.

Figure 4:
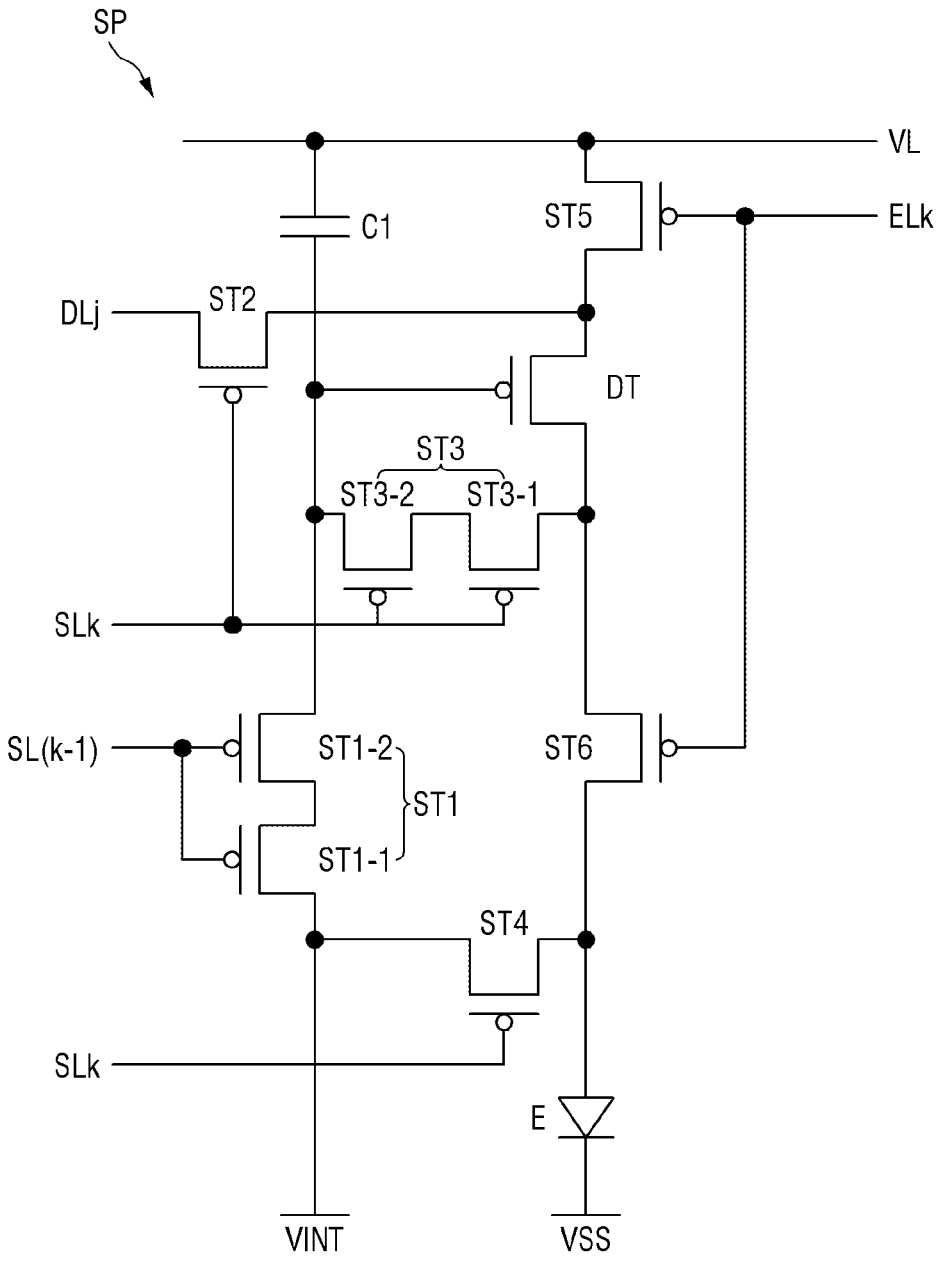
FIG. 4 is a circuit diagram illustrating a pixel of a display device according to an embodiment.

FIG. 4 is a circuit diagram illustrating a pixel of a display device according to an embodiment.

Referring to FIG. 4, in an embodiment, the pixels SP may be arranged on the display panel 100 along a plurality of rows and a plurality of columns. In one embodiment, for example, the pixel SP may be disposed in a k-th row and a j-th column of the display area DA. In this case, the pixel SP may be connected to a (k−1)-th (herein, k is a natural number of 2 or greater) scan line SL(k−1), a k-th scan line SLk, a k-th emission control line ELk, and a j-th (herein, j is a natural number) data line DLj. In such an embodiment, the pixel SP may be connected to a voltage supply line VL that supplies a first driving voltage VDD, an initialization voltage line that supplies an initialization voltage VINT, and a voltage supply line that supplies a second driving voltage VSS.

The pixel SP may include a driving transistor DT, a light emitting element E, switching elements, and a first capacitor C1. In one embodiment, for example, the switching elements may include first to sixth switching transistors ST1, ST2, ST3, ST4, ST5, and ST6.

The driving transistor DT controls a source-drain current (Isd) (hereinafter referred to as "driving current") based on the data voltage applied to the gate electrode. When a source-gate voltage (Vsg) of the driving transistor DT exceeds a threshold voltage (Vth), the driving current Isd may flow through the channel of the driving transistor DT. In one embodiment, for example, the driving current (Isd) is proportional to a square of a difference between the gate-source voltage (Vsg) and the threshold voltage (Vth) of the driving transistor DT as shown in Equation 1 below.

$$Isd=k'\times(Vsg-Vth)^2 \quad \text{[Equation 1]}$$

In Equation 1, k' denotes a proportional coefficient determined by the structure and physical characteristics of the driving transistor DT, Vsg denotes a source-gate voltage of the driving transistor DT, and Vth denotes a threshold voltage of driving transistor DT.

The light emitting element E may receive the driving current (Isd) to emit light. The emission amount or luminance of the light emitting element E may be proportional to the intensity of the driving current (Isd).

The light emitting element E may be an organic light emitting diode including a first electrode, a second electrode, and an organic light emitting layer disposed between the first electrode and the second electrode. Alternatively, the light emitting element E may be an inorganic light emitting element including a first electrode, a second electrode, and an inorganic semiconductor disposed between the first electrode and the second electrode. Alternatively, the light emitting element E may be a quantum dot light emitting element including a first electrode, a second electrode, and a quantum dot light emitting layer disposed between the first electrode and the second electrode. Alternatively, the light emitting element E may be a micro light emitting diode. In one embodiment, for example, the first electrode of the light emitting element E may be an anode electrode, and the second electrode thereof may be a cathode electrode, but the invention is not limited thereto.

The first electrode or anode electrode of the light emitting element E may be connected to the second electrode or drain electrode of the fourth switching transistor ST4 and the second electrode or drain electrode of the sixth switching transistor ST6. The second electrode or cathode electrode of the light emitting element E may be connected to the voltage supply line that supplies the second driving voltage VSS.

The first switching transistor ST1 may selectively supply an initialization voltage VINT to the gate electrode of the driving transistor DT. In one embodiment, for example, the first switching transistor ST1 may be a dual transistor including a first-first switching transistor ST1-1 and a second-first switching transistor ST1-2. The first-first switching transistor ST1-1 and the second-first switching transistor ST1-2 may be turned on in response to the scan signal of the (k−1)-th scan line SL(k−1) to supply the initialization voltage VINT to the gate electrode of the driving transistor DT. The gate electrode of the driving transistor DT may receive the initialization voltage VINT to be discharged. The gate electrode of the first-first switching transistor ST1-1 may be connected to the (k−1)-th scan line SL(k−1), the first electrode thereof may be connected to the initialization voltage line that supplies the initialization voltage VINT, and the second electrode thereof may be connected to the first electrode of the second-first switching transistor ST1-2. The gate electrode of the second-first switching transistor ST1-2 may be connected to the (k−1)-th scan line SL(k−1), the first electrode thereof may be connected to the second electrode of the first-first switching transistor ST1-1, and the second electrode thereof may be connected to the gate electrode of the driving transistor DT. In one embodiment, for example, the first electrode of the first switching transistor ST1 may be a source electrode, and the second electrode thereof may be a drain electrode.

The second switching transistor ST2 may selectively supply a data voltage to the first electrode of the driving transistor DT. The second switching transistor ST2 may be turned on in response to the scan signal of the k-th scan line SLk to supply the data voltage to the first electrode of the driving transistor DT. The gate electrode of the second switching transistor ST2 may be connected to the k-th scan line SLk, the first electrode thereof may be connected to the j-th data line DLj, and the second electrode thereof may be connected to the first electrode of the driving transistor DT. In one embodiment, for example, the first electrode of the second switching transistor ST2 may be a source electrode, and the second electrode thereof may be a drain electrode.

The third switching transistor ST3 may selectively connect the second electrode and gate electrode of the driving transistor DT. In one embodiment, for example, the third switching transistor ST3 may be a dual transistor including a third-first switching transistor ST3-1 and a third-second switching transistor ST3-2. The third-first switching transistor ST3-1 and the third-second switching transistor ST3-2 may be turned on in response to the scan signal of the k-th scan line SLk to connect the second electrode and gate electrode of the driving transistor DT. That is, when the third-first switching transistor ST3-1 and the third-second switching transistor ST3-2 are turned on, the second electrode and gate electrode of the driving transistor DT are connected, and thus the driving transistor DT may be driven as a diode. The gate electrode of the third-first switching transistor ST3-1 may be connected to the k-th scan line SLk, the first electrode thereof may be connected to the second electrode of the driving transistor DT, and the second electrode thereof may be connected to the first electrode of the third-second switching transistor ST3-2. The gate electrode of the third-second switching transistor ST3-2 may be connected to the k-th scan line SLk, the first electrode thereof may be connected to the second electrode of the third-first switching transistor ST3-1, and the second electrode thereof may be connected to the gate electrode of the driving transistor DT. In one embodiment, for example, the first electrode of the third switching transistor ST3 may be a source electrode, and the second electrode thereof may be a drain electrode.

The fourth switching transistor ST4 may selectively supply an initialization voltage VINT to the first electrode of the light emitting element E. The fourth switching transistor ST4 may be turned on in response to the scan signal of the k-th scan line SLk to supply the initialization voltage VINT to the first electrode of the light emitting element E. The first electrode of the light emitting element E may receive the initialization voltage VINT to be discharged. The gate electrode of the fourth switching transistor ST4 may be connected to the k-th scan line SLk, the first electrode may be connected to the initialization voltage line that supplies the initialization voltage VINT, and the second electrode thereof may be connected to the first electrode of the light emitting element E. In one embodiment, for example, the first electrode of the fourth switching transistor ST4 may be a source electrode, and the second electrode thereof may be a drain electrode.

The fifth switching transistor ST5 may selectively supply a first driving voltage VDD to the first electrode of the driving transistor DT. The fifth switching transistor ST5 may be turned on in response to the emission signal of the k-th emission control line ELk to supply the first driving voltage VDD to the first electrode of the driving transistor DT. The gate electrode of the fifth switching transistor ST5 may be connected to the k-th emission control line ELk, the first electrode thereof may be connected to the voltage supply line VL that supplies the first driving voltage VDD, and the second electrode thereof may be connected to the first electrode of the driving transistor DT. In one embodiment, for example, the first electrode of the fifth switching transistor ST5 may be a source electrode, and the second electrode thereof may be a drain electrode.

The sixth switching transistor ST6 may selectively connect the second electrode of the driving transistor DT and the first electrode of the light emitting element E. The sixth switching transistor ST6 may be turned on in response to the emission signal of the k-th emission control line ELk to connect the second electrode of the driving transistor DT and the first electrode of the light emitting element E. The gate electrode of the sixth switching transistor ST6 may be connected to the k-th emission control line ELk, the first electrode thereof may be connected to the second electrode of the driving transistor DT, and the second electrode thereof may be connected to the first electrode of the light emitting element E. In one embodiment, for example, the first electrode of the sixth switching transistor ST6 may be a source electrode, and the second electrode thereof may be a drain electrode. When both the fifth switching transistor ST5 and the sixth switching transistor ST6 are turned on, the driving current Isd may be supplied to the light emitting element E.

The first capacitor C1 may be connected between the gate electrode of the driving transistor DT and the voltage supply line VL. One electrode of the first capacitor C1 may be connected to the voltage supply line VL, and the other electrode thereof may be connected to the gate electrode of the driving transistor DT, thereby maintaining a potential difference between the voltage supply line VL and the gate electrode of the driving transistor DT.

In one embodiment, for example, the semiconductor layer of each of the first to sixth switching transistors ST1, ST2, ST3, ST4, ST5, ST6, and the driving transistor DT may be formed through a low-temperature poly silicon ("LTPS") process using polysilicon, but the invention is not limited thereto.

Figure 5:
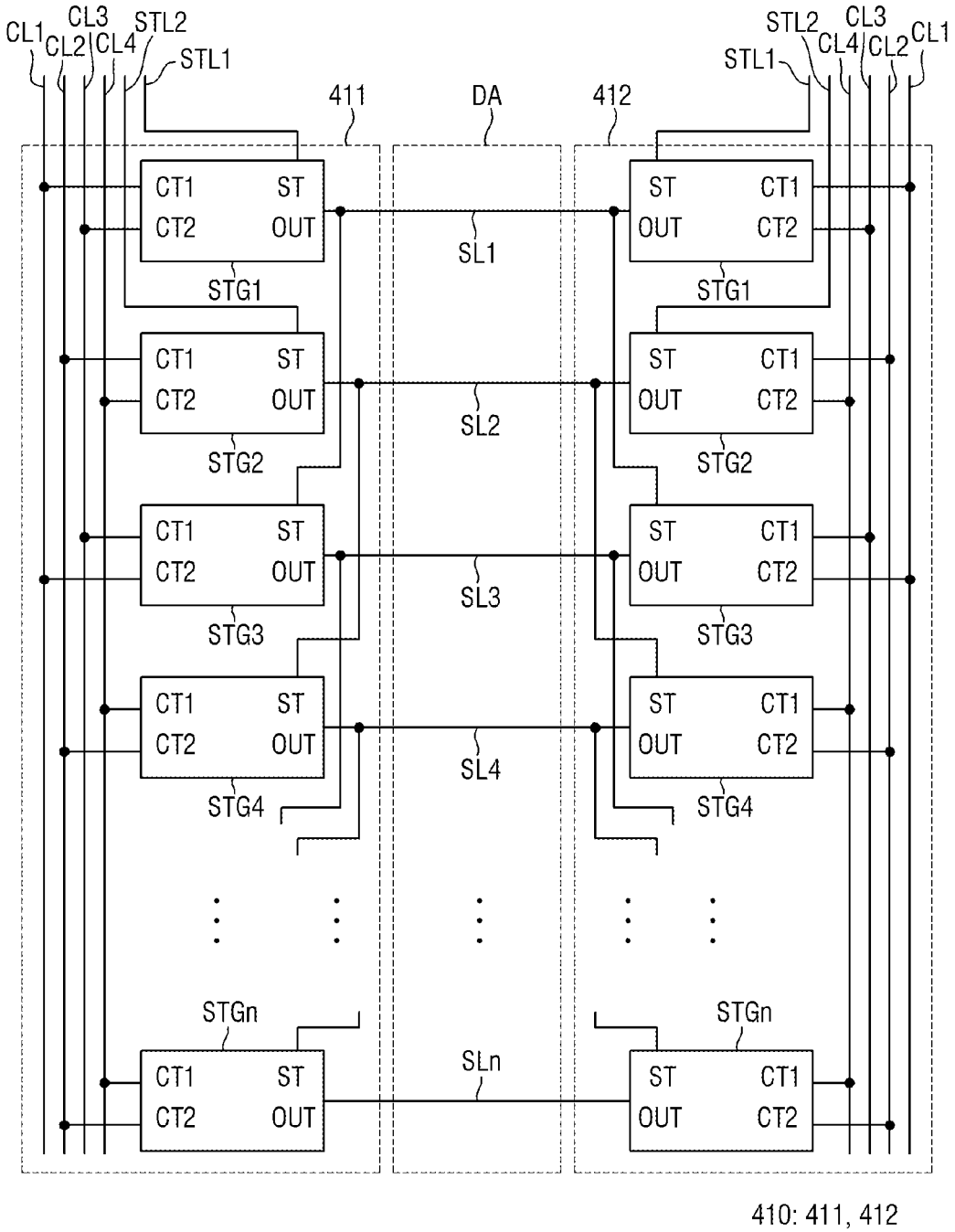
FIG. 5 is block diagram illustrating a scan driver of a display device according to an embodiment.

FIG. 5 is a block diagram illustrating a scan driver of a display device according to an embodiment.

Referring to FIG. 5, an embodiment of the scan driving circuit 410 may include a first scan driving circuit 411 and a second scan driving circuit 412. The first scan driving circuit 411 may be disposed at one side of the display panel 100, and may include a plurality of stages STG1 to STGn. The second scan driving circuit 412 may be disposed on another side of the display panel 100, and may include a plurality of stages STG1 to STGn. The first scan driving circuit 411 and the second scan driving circuit 412 may be disposed opposite to each other. In one embodiment, for example, the first and second scan driving circuits 411 and 412 may be disposed at both opposing sides of the display panel 100, respectively, to output a same scan signal, but the invention is not limited thereto. Hereinafter, for convenience of description, the plurality of stages STG1 to STGn of the first scan driving circuit 411 will be mainly described, and any repetitive detailed description of the plurality of stages STG1 to STGn of the second scan driving circuit 412 will be omitted.

Each of the plurality of stages STG1 to STGn may include first and second clock terminals CT1 and CT2, a start terminal ST, and an output terminal OUT.

The first stage STG1 may be connected to a first clock line CL1 through the first clock terminal CT1, may be connected to a third clock line CL3 through the second clock terminal CT2, and may be connected to a first start signal line STL1 through the start terminal ST. The first clock terminal CT1 of the first stage STG1 may receive a first clock signal from the first clock line CL1, the second clock terminal CT2 thereof may receive a third clock signal from the third clock line CL3, and the start terminal ST thereof may receive a first start signal from the first start signal line STL1. The output terminal OUT of the first stage STG1 may be connected to the first scan line SL1 and the start terminal ST of the third stage STG3.

The second stage STG2 may be connected to a second clock line CL2 through the first clock terminal CT1, may be connected to a fourth clock line CL4 through the second clock terminal CT2, and may be connected to a second start signal line STL2 through the start terminal ST. The first clock terminal CT1 of the second stage STG2 may receive a second clock signal from the second clock line CL2, the second clock terminal CT2 thereof may receive a fourth clock signal from the fourth clock line CL4, and the start terminal ST thereof may receive a second start signal from the second start signal line STL2. The output terminal OUT of the second stage STG2 may be connected to the second scan line SL2 and the start terminal ST of the fourth stage STG4.

The third stage STG3 may be connected to a third clock line CL3 through the first clock terminal CT1, may be connected to a first clock line CL1 through the second clock terminal CT2, and may be connected to the output terminal OUT of the first stage STG1 through the start terminal ST. The first clock terminal CT1 of the third stage STG3 may receive a third clock signal from the third clock line CL3, the second clock terminal CT2 thereof may receive a first clock signal from the first clock line CL1, and the start terminal ST thereof may receive an output signal of the first stage STG1. The output terminal OUT of the third stage STG3 may be connected to the third scan line SL3 and the start terminal ST of the fifth stage STG5.

The fourth stage STG4 may be connected to a fourth clock line CL4 through the first clock terminal CT1, may be connected to a second clock line CL2 through the second clock terminal CT2, and may be connected to the output terminal OUT of the second stage STG2 through the start terminal ST. The first clock terminal CT1 of the fourth stage STG4 may receive a fourth clock signal from the fourth clock line CL3, the second clock terminal CT2 thereof may receive a second clock signal from the second clock line CL1, and the start terminal ST thereof may receive an output signal of the second stage STG1. The output terminal OUT of the fourth stage STG4 may be connected to the fourth scan line SL4 and the start terminal ST of the sixth stage STG6.

In such an embodiment, as shown in FIG. 5, the start terminal ST of the (2p−1)-th stage STG(2p−1) (hereinafter, p is a natural number of n/2 or less) may be connected to the output terminal OUT of the (2p−3)-th stage STG(2p−3), and the start terminal ST of the 2p-th stage STG(2p) may be connected to the output terminal OUT of the (2p−2)-th stage STG(2p−2). Accordingly, the (2p−1)-th stage STG(2p−1) may receive the scan signal of the (2p−3)-th stage STG(2p−3), and the 2p-th stage STG(2p) may receive the scan signal of the (2p−2)-th stage STG(2p−2). Here, the (2p−1)-th stage STG(2p−1) may be an odd stage that supplies scan signals to the pixels SP arranged in odd rows, and the 2p-th stage STG(2p) may be an even stage that supplies scan signals to the pixels SP arranged in even rows.

The (2p−1)-th stage STG(2p−1) may receive the scan signal of the (2p−3)-th stage STG(2p−3), and may alternately receive the first clock signal and the third clock signal through the first or second clock terminal CT1 or CT2, thereby sequentially outputting scan signals to the pixels arranged in odd rows. The 2p-th stage STG(2p) may receive the scan signal of the (2p−2)-th stage STG(2p−2), and may alternately receive the second clock signal and the fourth clock signal through the first or second clock terminal CT1 or CT2, thereby sequentially outputting scan signals to the pixels arranged in even rows.

When the scan driver 400 receives the first start signal from the first start signal line STL1 and does not receive the second start signal from the second start signal line STL2, the (2p−1)-th stage STG(2p−1) may supply scan signals to the scan lines SL1, SL3, SLn−1 in odd rows, and the 2p-th stage STG(2p) may not supply scan signals to the scan lines SL2, SL4, SLn in even rows. In one embodiment, for example, where the first and second pixels RP and BP are connected to a same data line DL, the first pixels RP are connected to scan lines in odd rows, and the second pixels BP are connected to the scan lines in even rows, the scan driver 400 may perform a lighting inspection of the first pixels RP among the first and second pixels RP and BP based on the first start signal. In such an embodiment, where the first and second pixels RP and BP are connected to a same data line DL, the first pixels RP are connected to scan lines in odd rows, and the second pixels BP are connected to the scan lines in even rows, the scan driver 400 may perform a lighting inspection of the second pixels BP among the first and second pixels RP and BP based on the second start signal. Therefore, in an embodiment of the display device 10, the light inspection of the pixels in the odd rows or the pixels in the even rows among the pixels SP arranged in the plurality of rows may be selectively performed, thereby sufficiently securing the charging time of the corresponding data line. In an embodiment of the display device 10, when the lighting inspection of the plurality of pixels SP having high resolution is performed, the color mixing between the first pixels RP and the second pixels BP may be effectively prevented, and the reliability of a lighting inspection may be improved.

Figure 6:
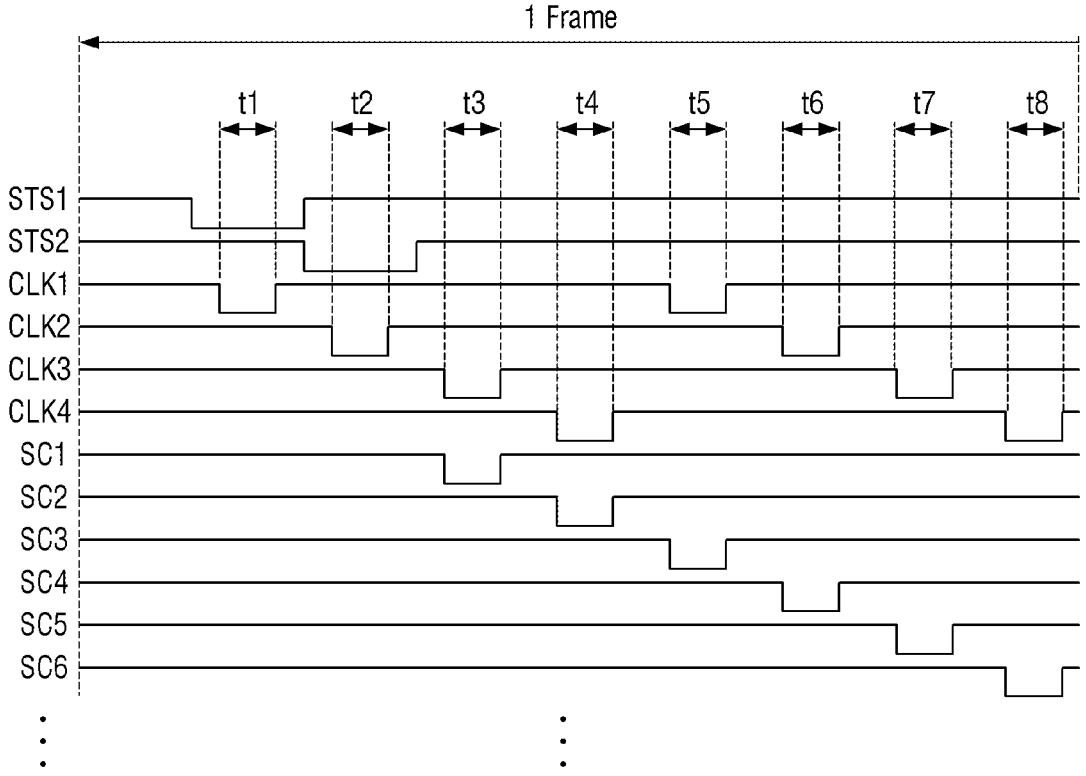
FIG. 6 is a waveform diagram illustrating input/output signals of a scan driver in a display device according to an embodiment.

FIG. 6 is a waveform diagram illustrating input/output signals of a scan driver in a display device according to an embodiment. The input/output signals of the scan driver 400 of FIG. 6 are signals provided at the display mode of the display device 10, and are distinguished from the signals provided at the lighting inspection mode of the display device 10.

Referring to FIG. 6, the first start signal STS1 may be applied to the start terminal ST of the first stage STG1, and the second start signal STS2 may be applied to the start terminal ST of the second stage STG2. In one embodiment, for example, the first start signal STS1 may have a gate low voltage during a first period t1 of one frame (1 Frame in FIG. 6), and the second start signal STS2 may have a gate low voltage during a second period t2 of one frame.

The first clock signal CLK1 may be applied to the first or second clock terminal CT1 or CT2 of the (2p−1)-th stage STG(2p−1) (hereinafter, p is a natural number of n/2 or less), and the second clock signal CLK2 may be applied to the first or second clock terminals CT1 or CT2 of the 2p-th stage STG(2p). The first clock signal CLK1 may have a gate low voltage during the (4q−3)-th period (hereinafter, q is a natural number of n/4 or less) from the first period t1 of one frame, and the second clock signal CLK2 may have a gate low voltage during the (4q−2)-th period from the second period t2 of one frame.

The third clock signal CLK3 may be applied to the first or second clock terminal CT1 or CT2 of the (2p−1)-th stage STG(2p−1), and the fourth clock signal CLK4 may be applied to the first or second clock terminal CT1 or CT2 of the 2p-th stage STG(2p). The third clock signal CLK3 may have a gate low voltage during the (4q−1)-th period from a third period t3 of one frame, and the fourth clock signal CLK4 may have a gate low voltage during the 4q-th period from a fourth period t4 of one frame.

The plurality of stages STG1 to STGn may output a plurality of scan signals SC1 to SCn, phases of which are sequentially delayed based on the first and second start signals STS1 and STS2 and the first to fourth clock signals CLK1 to CLK4. The plurality of stages STG1 to STGn may supply the scan signals SC1 to SCn to the plurality of pixels SP through the plurality of scan lines SL1 to SLn, and the plurality of pixels SP may emit light having a predetermined luminance based on the scan signals SC1 to SCn and the data voltage.

Figure 7:
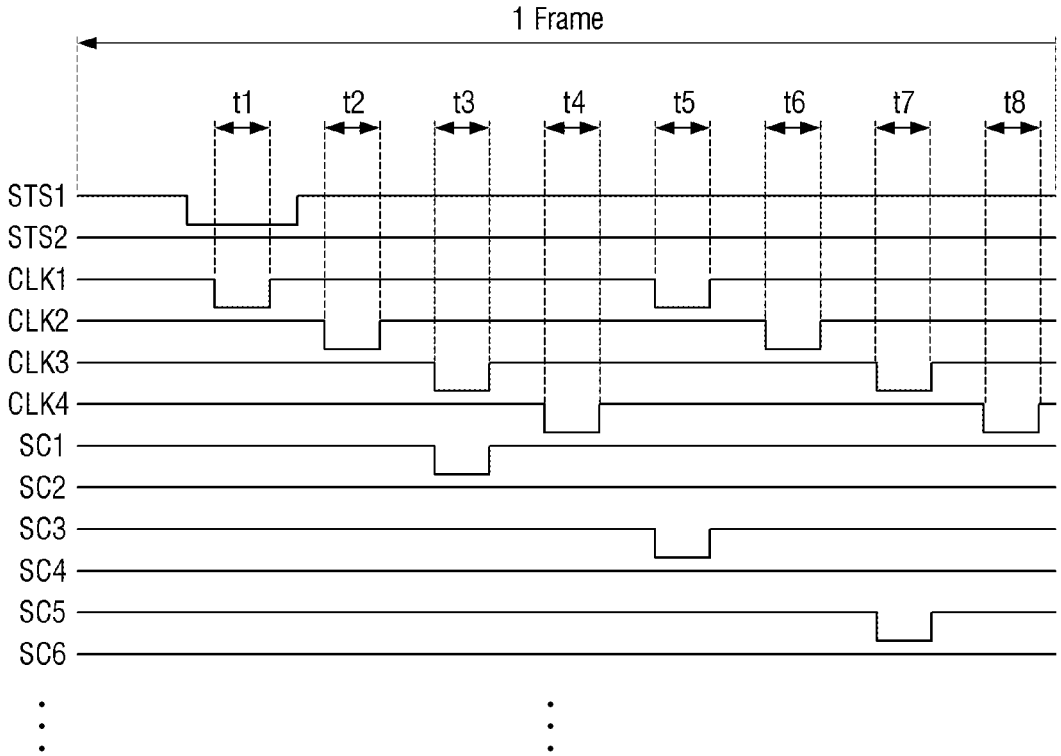
FIG. 7 is a waveform diagram illustrating input/output signals of odd stages in the display device of FIG. 5.

FIG. 7 is a waveform diagram illustrating input/output signals of odd stages in the display device of FIG. 5. Here, the odd stage may be the (2p−1)-th stage STG(2p−1) that supplies scan signals to the scan lines SL in odd rows, among the plurality of stages STG1 to STGn.

Referring to FIG. 7, the first start signal STS1 may be applied to the start terminal ST of the first stage STG1, and the first start signal STS1 may have a gate low voltage during the first period t1 of one frame. The first stage STG1 may output a first scan signal SC1 based on the first start signal STS1 and the first and third clock signals CLK1 and CLK3. The first scan signal SC1 may be applied to the first scan line SL1 and the start terminal ST of the third stage STG3.

The third stage STG3 may output a third scan signal SC3 based on the first scan signal SC1 and the first and third clock signals CLK1 and CLK3 of the first stage STG1. The third scan signal SC3 may be applied to the third scan line SL3 and the start terminal ST of the fifth stage STG5.

In an embodiment, as described above, the (2p−1)-th stage STG(2p−1) may receive the scan signal of the (2p−3)-th stage STG(2p−3), and may alternately receive the first clock signal and the third clock signal through the first or second clock terminal CT1 or CT2, thereby sequentially outputting scan signals to the pixels arranged in odd rows.

The second start signal STS2 may be applied to the start terminal ST of the second stage STG2. When the lighting inspection of the pixels SP arranged in odd rows is performed, the second start signal STS2 may maintain a gate high voltage during one frame. The second stage STG2 may not output the second scan signal SC2, and the 2p-th stage STG(2p) may not output the scan signal. Therefore, the pixels SP arranged in even rows may maintain a light-off state.

In one embodiment, for example, where the first and second pixels RP and BP are connected to a same data line DL, the first pixels RP are connected to scan lines in odd rows, and the second pixels BP are connected to the scan lines in even rows, the scan driver 400 may perform a lighting inspection of the first pixels RP among the first and second pixels RP and BP based on the first start signal. Therefore, in an embodiment of the display device 10, the light inspection of the pixels in the odd rows among the pixels SP arranged in the plurality of rows may be selectively performed, thereby sufficiently securing the charging time of the corresponding data line. In an embodiment of the display device 10, when the lighting inspection of the plurality of pixels SP having high resolution is performed, the color mixing between the first pixels RP and the second pixels BP may be prevented, and the reliability of a lighting inspection may be improved.

Figure 8:
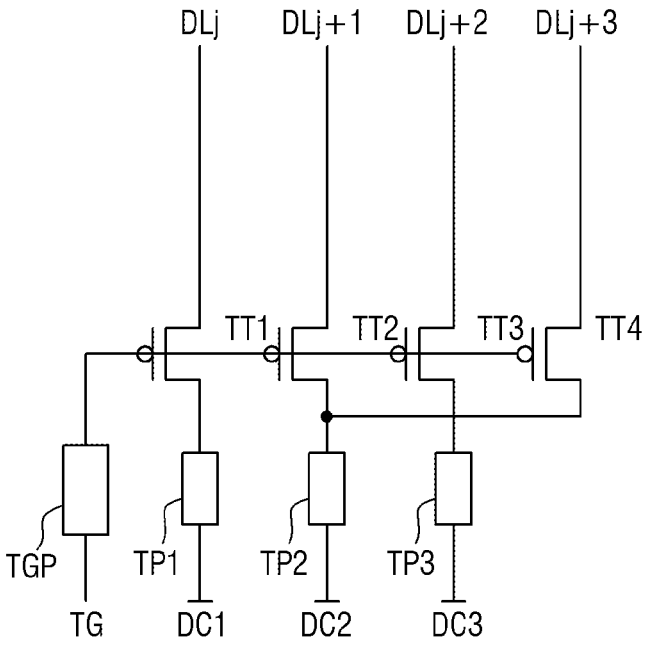
FIG. 8 is a view illustrating a process of supplying a lighting voltage in a display device according to an embodiment.

FIG. 8 is a view illustrating a process of supplying a lighting voltage in a display device according to an embodiment.

Referring to FIG. 8, the test pads TP may include first to third test pads TP1, TP2, and TP3. The first to third test pads TP1, TP2, and TP3 may receive first to third lighting voltages DC1, DC2, and DC3, respectively. Each of the first to third lighting voltages DC1, DC2, and DC3 may be a gray voltage that turns on the pixels SP or a black voltage that turns off the pixels SP. Each of the first to third lighting voltages DC1, DC2, and DC3 may be a direct current ("DC") voltage, but is not limited thereto. In one embodiment, for example, the first to third test pads TP1, TP2, and TP3 may be connected to a lighting device or a power supply, and may receive the first to third lighting voltages DC1, DC2, DC3.

The test transistors may include first to fourth test transistors TT1 to TT4. The first test transistor TT1 may be connected between the first test pad TP1 and the j-th data line DLj, and the second test transistor TT2 may be connected between the second test pad TP2 and the (j+1)-th data line DLj+1. The third test transistor TT3 may be connected between the third test pad TP3 and the (j+2)-th data line DLj+2, and the fourth test transistor TT4 may be connected between the second test pad TP2 and the (j+3)-th data line DLj+3. Each of the first to fourth test transistors TT1 to TT4 is connected between a corresponding test pad of the test pads TP and a corresponding data line DL of the plurality of data lines DL, thereby selectively supplying the first to third lighting voltages DC1, DC2, and DC3 to the plurality of data lines DL. In one embodiment, for example, the first to fourth test transistors TT1 to TT4 may receive a same test gate signal TG, and may thus be turned on or off at the same time.

The test gate pad TGP may receive a test gate signal TG, and may be connected to the gate electrodes of each of the first to fourth test transistors TT1 to TT4. In one embodiment, for example, the test gate pad TGP may be connected to a lighting device, and may receive a test gate signal TG turning on the first to fourth test transistors TT1 to TT4 from the lighting device.

Figure 9:
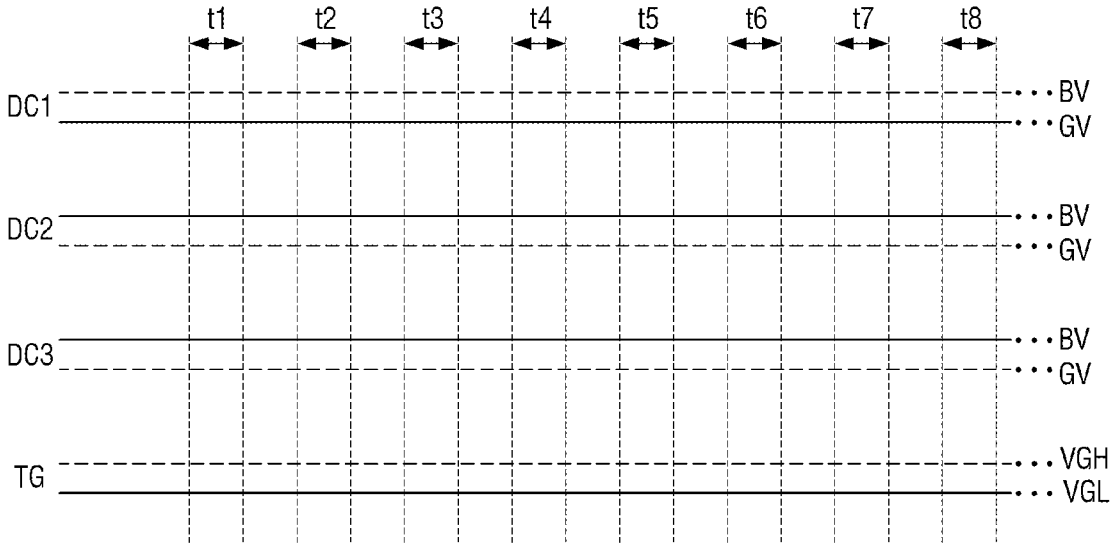
FIG. 9 is a waveform diagram illustrating a lighting voltage and a test gate signal in a display device according to an embodiment.
Figure 10:
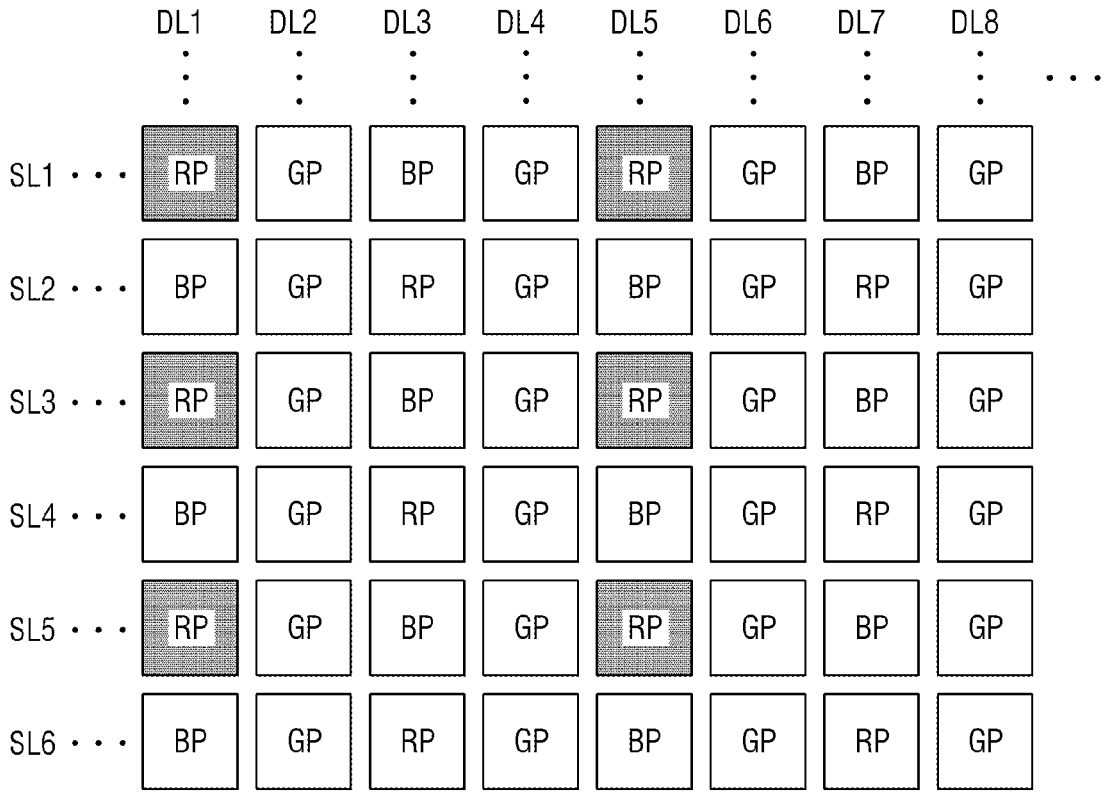
FIG. 10 is a diagram illustrating the result of a lighting inspection of first pixels in the display device of FIG. 9.

FIG. 9 is a waveform diagram illustrating a lighting voltage and a test gate signal in a display device according to an embodiment, and FIG. 10 is a diagram illustrating the result of a lighting inspection of first pixels in the display device of FIG. 9.

Referring to FIGS. 9 and 10, in an embodiment of the display device 10, the lighting inspection of some pixels among the plurality of pixels SP may be performed. In an embodiment of the display device 10, the first to third lighting voltages DC1, DC2, and DC3 may be supplied through the first to third test pads TP1, TP2, and TP3, and the test gate signal TG may be supplied through the test gate pad TGP.

The first lighting voltage DC1 may maintain a gray voltage GV that turn on the pixels SP during one frame or during the first to eighth periods t1 to t8. The second and third lighting voltages DC2 and DC3 may maintain a black voltage BV that turns off the pixels SP during one frame or during the first to eighth periods t1 to t8. When the pixels SP receive the gray voltage GV from the data line DL, the pixels SP may be turned on, and when the pixels SP receive the black voltage BV from the data line DL, the pixels SP may be turned off.

The test gate signal TG may maintain a gate low voltage VGL during one frame or during the first to eighth periods t1 to t8. Accordingly, each of the first to fourth test transistors TT1 to TT4 may receive the test gate signal TG to be turned on.

Referring to FIGS. 7 to 10, when the lighting inspection of the first pixels RP among the first and second pixels RP and BP connected to the first data line DL1 or the j-th data line DLj is performed, the first start signal STS1 may have a gate low voltage VGL during the first period t1 of one frame, and the second start signal STS2 may maintain a gate high voltage VGH during one frame. The (2p−1)-th stage STG(2p−1) may supply scan signals SC1, SC3, SC5, . . . to the scan lines SL1, SL3, SL5, . . . in odd rows, and the 2p-th stage STG(2p) may not output scan signals. The first lighting voltage DC1 may maintain a gray voltage GV during one frame, and the second and third lighting voltages DC2 and DC3 may maintain a black voltage BV during one frame. Accordingly, among the first and second pixels RP and BP connected to the first data line DL1 or the j-th data line DLj, the first pixels RP connected to the scan lines SL1, SL3, SL5, . . . in odd rows, may be turned on, and the second pixels BP connected to the scan lines SL2, SL4, SL6, . . . in even rows may be turned off. In one embodiment, for example, in the display device 10, the charging time of the first data line DL1 may be sufficiently secured by turning on the first pixel RP connected to the third scan line SL3 without turning on the second pixel BP connected to the second scan line SL2 after turning on the first pixel RP connected to the first data line DL1 and the first scan line SL1. In such an embodiment of the display device 10, the color mixing between the first pixels RP and the second pixels BP may be effectively prevented, and the reliability of a lighting inspection may be improved.

Figure 11:
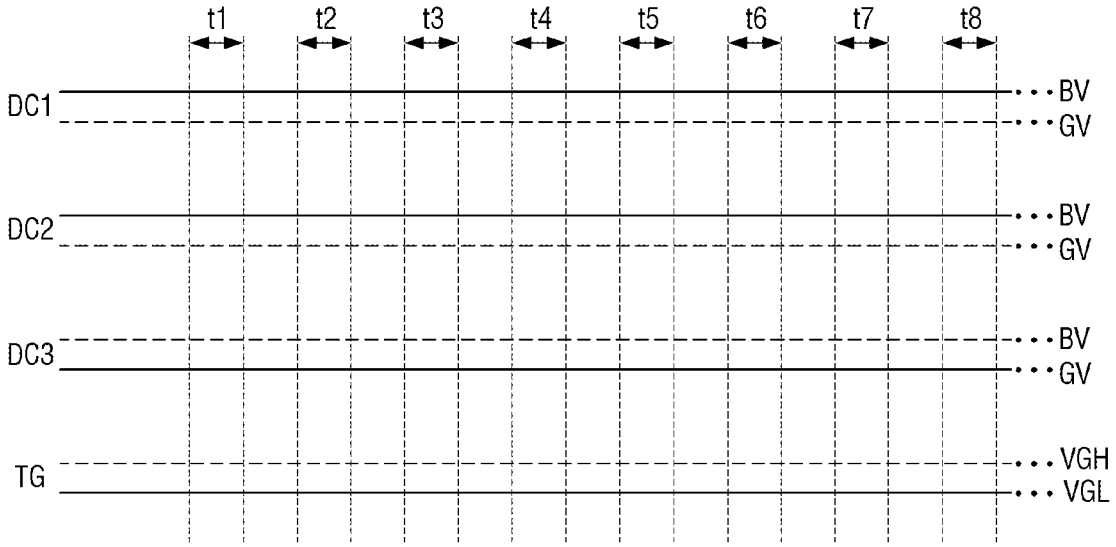
FIG. 11 is a waveform diagram illustrating a lighting voltage and a test gate signal in a display device according to an alternative embodiment.
Figure 12:
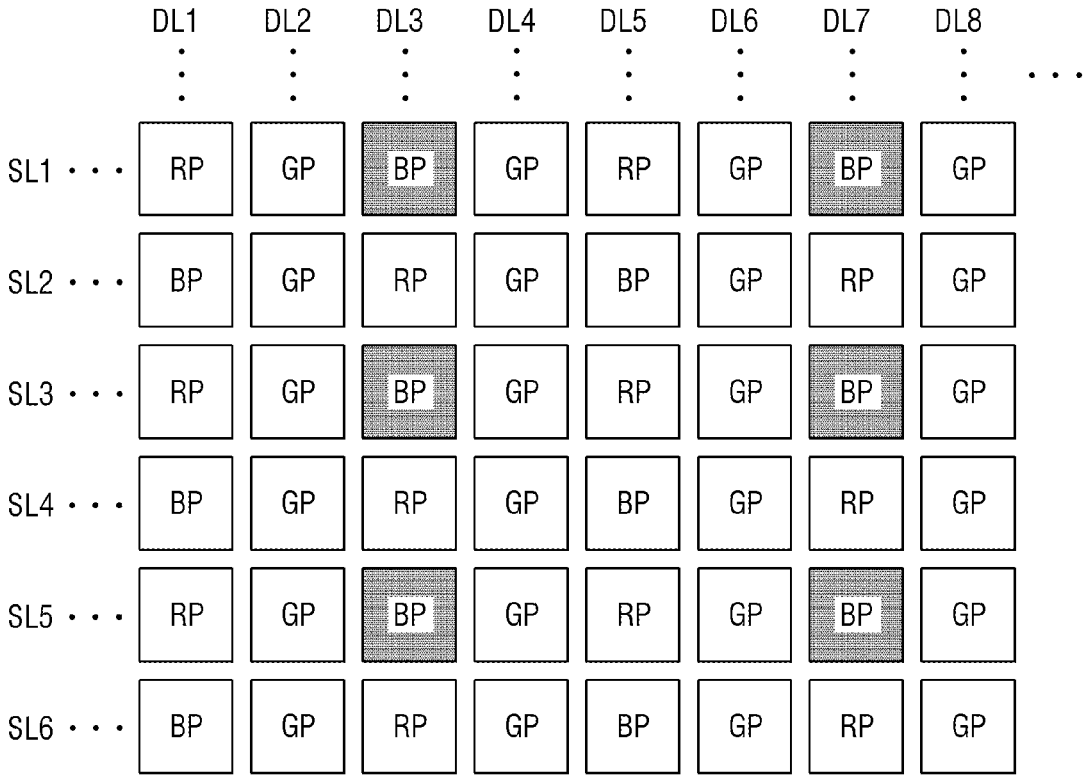
FIG. 12 is a diagram illustrating the result of a lighting inspection of second pixels in the display device of FIG. 11.

FIG. 11 is a waveform diagram illustrating a lighting voltage and a test gate signal in a display device according to an alternative embodiment, and FIG. 12 is a diagram illustrating the result of a lighting inspection of second pixels in the display device of FIG. 11.

Referring to FIGS. 11 and 12, in an embodiment of the display device 10, the lighting inspection of some pixels among the plurality of pixels SP may be performed. In an embodiment of the display device 10, the first to third lighting voltages DC1, DC2, and DC3 may be supplied through the first to third test pads TP1, TP2, and TP3, and the test gate signal TG may be supplied through the test gate pad TGP.

The first and second lighting voltage DC1 and DC2 may maintain a black voltage BV that turn off the pixels SP during one frame or during the first to eighth periods t1 to t8. The third lighting voltage DC3 may maintain a gray voltage GV that turns on the pixels SP during one frame or during the first to eighth periods t1 to t8. When the pixels SP receive the gray voltage GV from the data line DL, the pixels SP may be turned on, and when the pixels SP receive the black voltage BV from the data line DL, the pixels SP may be turned off.

The test gate signal TG may maintain a gate low voltage VGL during one frame or during the first to eighth periods t1 to t8. Accordingly, each of the first to fourth test transistors TT1 to TT4 may receive the test gate signal TG to be turned on.

Referring to FIGS. 7, 8, 11, and 12, when the lighting inspection of the second pixels BP among the first and second pixels RP and BP connected to the third data line DL3 or the (j+2)-th data line DLj+2 is performed, the first start signal STS1 may have a gate low voltage VGL during the first period t1 of one frame, and the second start signal STS2 may maintain a gate high voltage VGH during one frame. The (2p−1)-th stage STG(2p−1) may supply scan signals SC1, SC3, SC5, . . . to the scan lines SL1, SL3, SL5, in odd rows, and the 2p-th stage STG(2p) may not output scan signals. The first and second lighting voltages DC1 and DC2 may maintain a black voltage BV during one frame, and the third and third lighting voltage DC3 may maintain a gray voltage GV during one frame. Accordingly, among the first and second pixels RP and BP connected to the third data line DL3 or the (j+2)-th data line DLj+2, the second pixels BP connected to the scan lines SL1, SL3, SL5, . . . in odd rows, may be turned on, and the first pixels RP connected to the scan lines SL2, SL4, SL6, . . . in even rows may be turned off. In one embodiment, for example, in the display device 10, the charging time of the third data line DL3 may be sufficiently secured by turning on the second pixel BP connected to the third scan line SL3 without turning on the first pixel RP connected to the second scan line SL2 after turning on the second pixel BP connected to the third data line DL3 and the first scan line SL1. In the display device 10, the color mixing between the first pixels RP and the second pixels BP may be effectively prevented, and the reliability of a lighting inspection may be improved.

Figure 13:
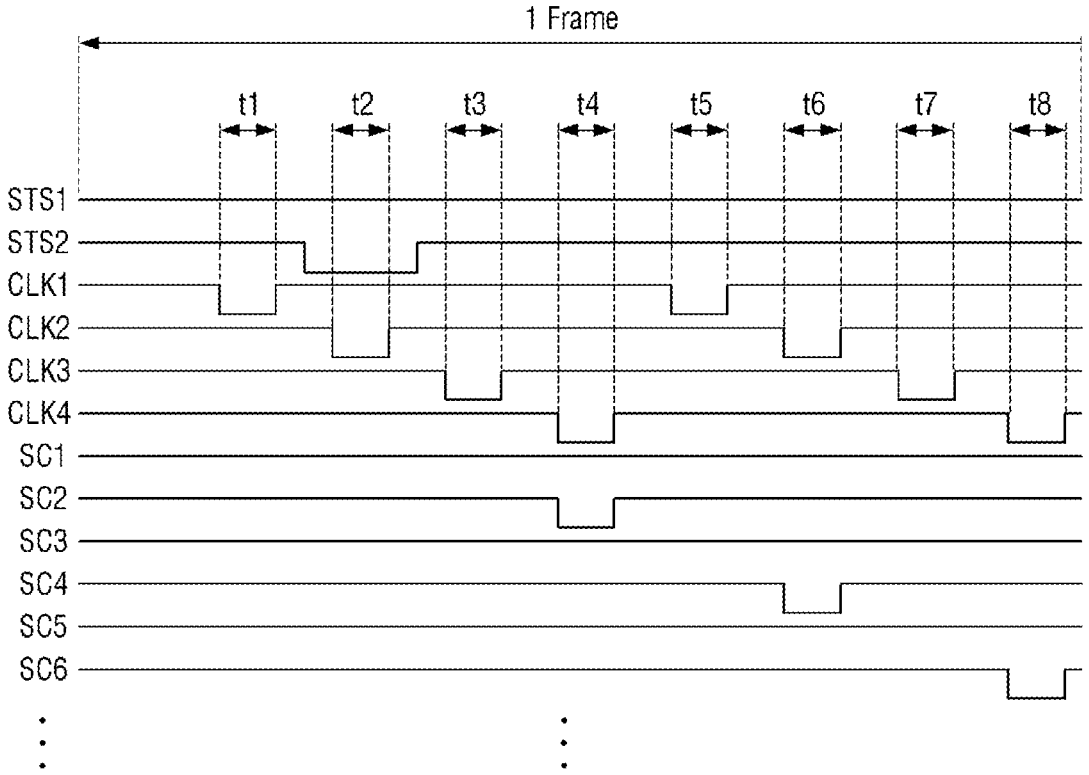
FIG. 13 is a waveform diagram illustrating input/output signals of even stages in the display device of FIG. 5.

FIG. 13 is a waveform diagram illustrating input/output signals of even stages in the display device of FIG. 5. Here, the even stage may be the 2p-th stage STG(2p) that supplies scan signals to the scan lines SL in even rows, among the plurality of stages STG1 to STGn.

Referring to FIG. 13, the second start signal STS2 may be applied to the start terminal ST of the second stage STG2, and the second start signal STS2 may have a gate low voltage during the second period t2 of one frame. The second stage STG2 may output a second scan signal SC2 based on the second start signal STS2 and the second and fourth clock signals CLK2 and CLK4. The second scan signal SC2 may be applied to the second scan line SL2 and the start terminal ST of the fourth stage STG4.

The fourth stage STG4 may output a fourth scan signal SC4 based on the second scan signal SC2 and the second and fourth clock signals CLK2 and CLK4 of the second stage STG2. The fourth scan signal SC4 may be applied to the fourth scan line SL4 and the start terminal ST of the sixth stage STG6.

In such an embodiment, as described above, the 2p-th stage STG(2p) may receive the scan signal of the (2p−2)-th stage STG(2p−2), and may alternately receive the second clock signal and the fourth clock signal through the first or second clock terminal CT1 or CT2, thereby sequentially outputting scan signals to the pixels arranged in even rows.

The first start signal STS1 may be applied to the start terminal ST of the first stage STG1. When the lighting inspection of the pixels SP arranged in even rows is performed, the first start signal STS1 may maintain a gate high voltage during one frame. The first stage STG1 may not output the first scan signal SC1, and the (2p−1)-th stage STG(2p−1) may not output the scan signal. Therefore, the pixels SP arranged in odd rows may maintain a light-off state.

In one embodiment, for example, when the first and second pixels RP and BP are connected to the same data line DL, the first pixels RP are connected to scan lines in odd rows, and the second pixels BP are connected to the scan lines in even rows, the scan driver 400 may perform a lighting inspection of the second pixels BP among the first and second pixels RP and BP based on the second start signal. As described above, in an embodiment of the display device 10, the light inspection of the pixels in the even rows among the pixels SP arranged in the plurality of rows may be selectively performed, thereby sufficiently securing the charging time of the corresponding data line. In an embodiment of the display device 10, when the lighting inspection of the plurality of pixels SP having high resolution is performed, the color mixing between the first pixels RP and the second pixels BP may be effectively prevented, and the reliability of a lighting inspection may be improved.

Figure 14:
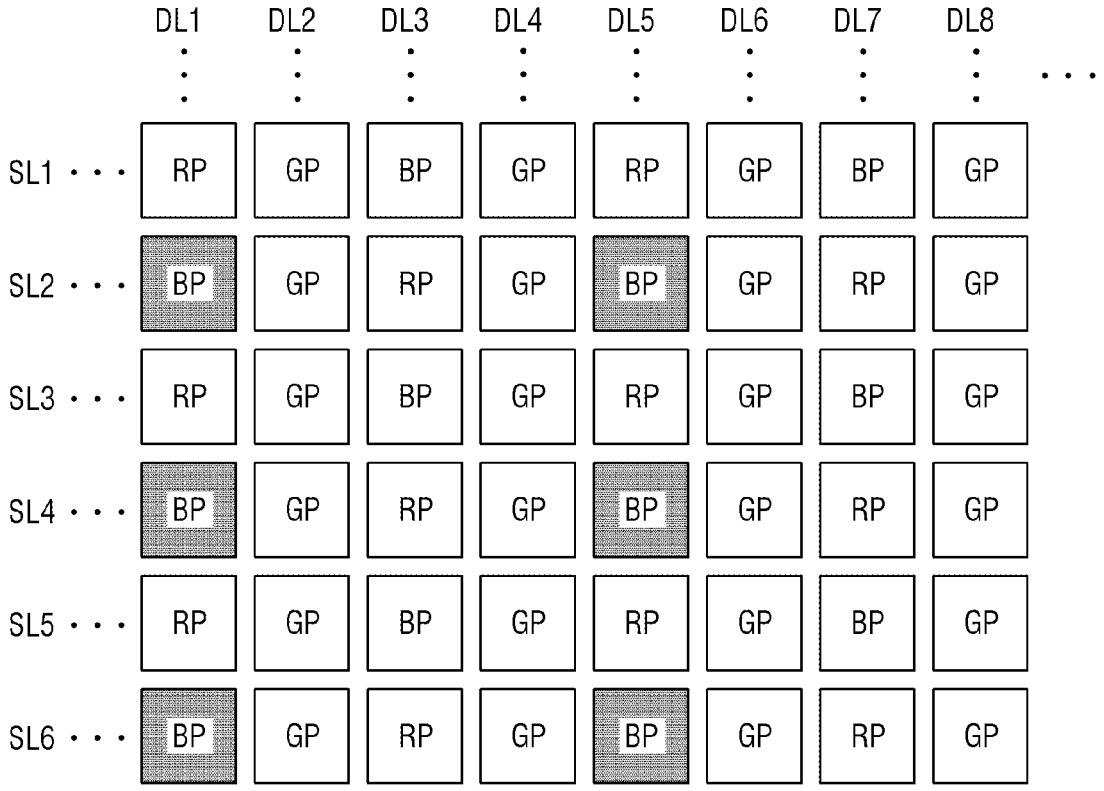
FIG. 14 is a diagram illustrating the result of a lighting inspection of second pixels in the display device of FIG. 13.

FIG. 14 is a diagram illustrating the result of a lighting inspection of second pixels in the display device of FIG. 13.

Referring to FIG. 14 together with FIGS. 8, 9, and 13, in an embodiment of the display device 10, the lighting inspection of some pixels among the plurality of pixels SP may be performed. In an embodiment of the display device 10, the first to third lighting voltages DC1, DC2, and DC3 may be supplied through the first to third test pads TP1, TP2, and TP3, and the test gate signal TG may be supplied through the test gate pad TGP.

The first lighting voltage DC1 may maintain a gray voltage GV that turns on the pixels SP during one frame or during the first to eighth periods t1 to t8. The second and third lighting voltages DC2 and DC3 may maintain a black voltage BV that turns off the pixels SP during one frame or during the first to eighth periods t1 to t8. When the pixels SP receive the gray voltage GV from the data line DL, the pixels SP may be turned on, and when the pixels SP receive the black voltage BV from the data line DL, the pixels SP may be turned off.

The test gate signal TG may maintain a gate low voltage VGL during one frame or during the first to eighth periods t1 to t8. Accordingly, each of the first to fourth test transistors TT1 to TT4 may receive the test gate signal TG to be turned on.

When the lighting inspection of the second pixels BP among the first and second pixels RP and BP connected to the first data line DL1 or the j-th data line DLj is performed, the second start signal STS2 may have a gate low voltage VGL during the second period t2 of one frame, and the first start signal STS1 may maintain a gate high voltage VGH during one frame. The 2p-th stage STG(2p) may supply scan signals SC2, SC4, SC6, . . . to the scan lines SL1, SL3, SL5, . . . in even rows, and the (2p−1)-th stage STG(2p−1) may not output scan signals. The first voltage DC1 may maintain a gray voltage GV during one frame, and the second and third lighting voltages DC2 and DC3 may maintain a black voltage GV during one frame. Accordingly, among the first and second pixels RP and BP connected to the first data line DL1 or the j-th data line DLj, the second pixels BP connected to the scan lines SL2, SL4, SL6, . . . in even rows may be turned on, and the first pixels RP connected to the scan lines SL1, SL3, SL5, . . . in odd rows may be turned off. In one embodiment, for example, in the display device 10, the charging time of the first data line DL1 may be sufficiently secured by turning on the second pixel BP connected to the fourth scan line SL4 without turning on the first pixel RP connected to the third scan line SL3 after turning on the second pixel BP connected to the first data line DL1 and the second scan line SL2. In such an embodiment of the display device 10, the color mixing between the first pixels RP and the second pixels BP may be effectively prevented, and the reliability of a lighting inspection may be improved.

Figure 15:
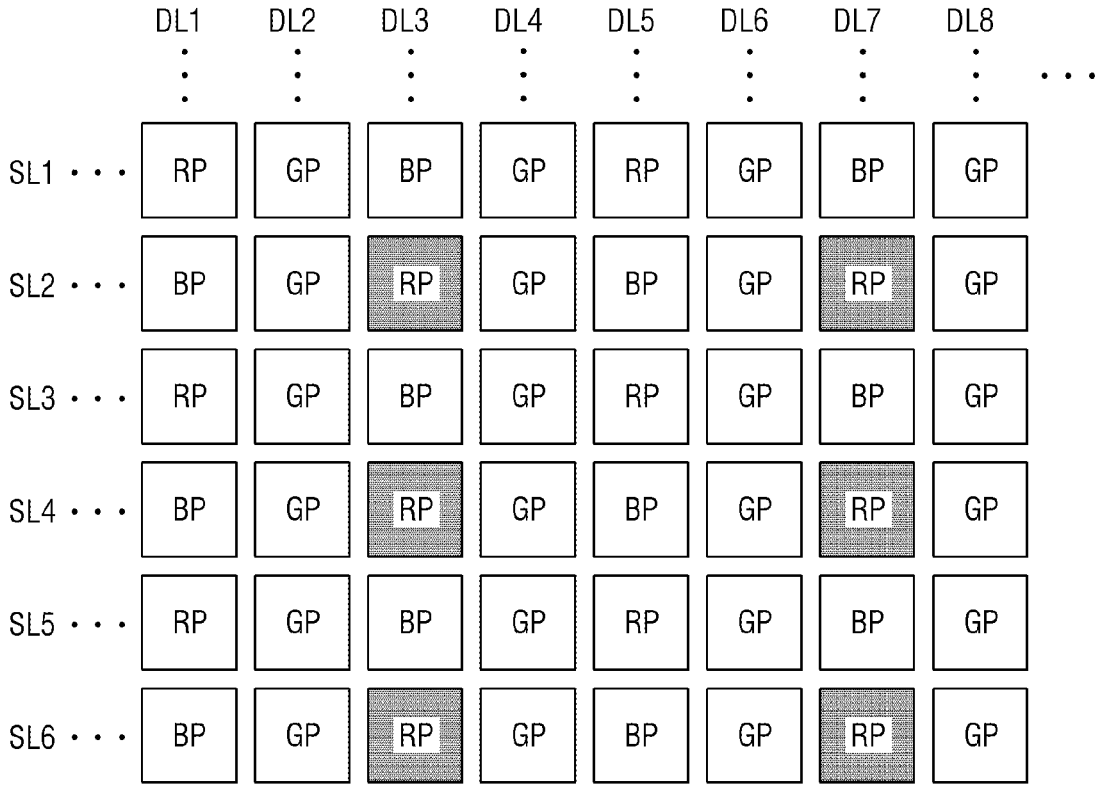
FIG. 15 is a diagram illustrating the result of a lighting inspection of first pixels in the display device of FIG. 13.

FIG. 15 is a diagram illustrating the result of a lighting inspection of first pixels in the display device of FIG. 13.

Referring to FIG. 15 together with FIGS. 8, 11, and 13, in an embodiment of the display device 10, the lighting inspection of some pixels among the plurality of pixels SP may be performed. In an embodiment of the display device 10, the first to third lighting voltages DC1, DC2, and DC3 may be supplied through the first to third test pads TP1, TP2, and TP3, and the test gate signal TG may be supplied through the test gate pad TGP.

The first and second lighting voltages DC1 and DC2 may maintain a black voltage BV that turns off the pixels SP during one frame or during the first to eighth periods t1 to t8. The third lighting voltage DC3 may maintain a gray voltage GV that turns on the pixels SP during one frame or during the first to eighth periods t1 to t8. When the pixels SP receive the gray voltage GV from the data line DL, the pixels SP may be turned on, and when the pixels SP receive the black voltage BV from the data line DL, the pixels SP may be turned off.

The test gate signal TG may maintain a gate low voltage VGL during one frame or during the first to eighth periods t1 to t8. Accordingly, each of the first to fourth test transistors TT1 to TT4 may receive the test gate signal TG to be turned on.

When the lighting inspection of the first pixels RP among the first and second pixels RP and BP connected to the third data line DL3 or the (j+2)-th data line DLj+2 is performed, the second start signal STS2 may have a gate low voltage VGL during the second period t2 of one frame, and the first start signal STS1 may maintain a gate high voltage VGH during one frame. The 2p-th stage STG(2p) may supply scan signals SC2, SC4, SC6, . . . to the scan lines SL1, SL3, SL5, . . . in even rows, and the (2p−1)-th stage STG(2p−1) may not output scan signals. The first and second voltages DC1 and DC2 may maintain a black voltage BV during one frame, and the third lighting voltages DC3 may maintain a gray voltage GV during one frame. Accordingly, among the first and second pixels RP and BP connected to the third data line DL3 or the (j+2)-th data line DLj+2, the first pixels RP connected to the scan lines SL2, SL4, SL6, . . . in even rows may be turned on, and the second pixels BP connected to the scan lines SL1, SL3, SL5, . . . in odd rows may be turned off. In one embodiment, for example, in the display device 10, the charging time of the third data line DL3 may be sufficiently secured by turning on the first pixel RP connected to the fourth scan line SL4 without turning on the second pixel BP connected to the third scan line SL3 after turning on the first pixel RP connected to the third data line DL3 and the second scan line SL2. In such an embodiment of the display device 10, the color mixing between the first pixels RP and the second pixels BP may be effectively prevented, and the reliability of a lighting inspection may be improved.

Figure 16:
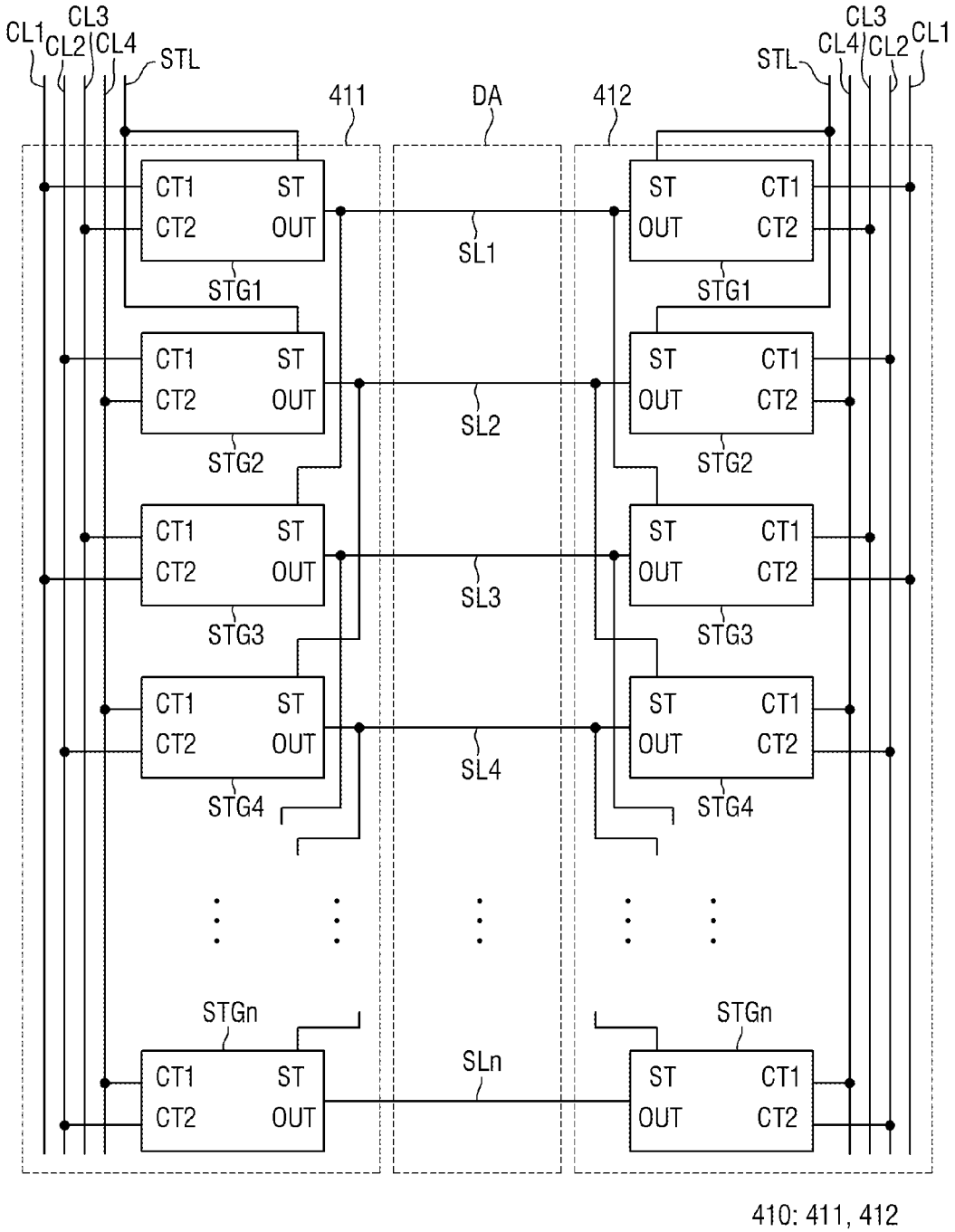
FIG. 16 is a block diagram illustrating a scan driver of a display device according to an alternative embodiment.

FIG. 16 is a block diagram illustrating a scan driver of a display device according to an embodiment.

The scan driver of the display device of FIG. 16 is substantially the same as the scan driver of the display device of FIG. 5 except for a start signal line STL. Accordingly, any repetitive detailed description of the same or like elements as those described above with reference to FIG. 5 will hereinafter be omitted or simplified.

Referring to FIG. 16, an embodiment of the scan driving circuit 410 may include a first scan driving circuit 411 and a second scan driving circuit 412. The first scan driving circuit 411 may be disposed at one side of the display panel 100, and may include a plurality of stages STG1 to STGn. The second scan driving circuit 412 may be disposed on another side of the display panel 100, and may include a plurality of stages STG1 to STGn. In one embodiment, for example, the first and second scan driving circuits 411 and 412 may be disposed at both opposing sides of the display panel 100, respectively, to output a same scan signal, but the invention is not limited thereto.

Each of the plurality of stages STG1 to STGn may include first and second clock terminals CT1 and CT2, a start terminal ST, and an output terminal OUT.

The first stage STG1 may be connected to a first clock line CL1 through the first clock terminal CT1, may be connected to a third clock line CL3 through the second clock terminal CT2, and may be connected to a first start signal line STL1 through the start terminal ST. The first clock terminal CT1 of the first stage STG1 may receive a first clock signal from the first clock line CL1, the second clock terminal CT2 thereof may receive a third clock signal from the third clock line CL3, and the start terminal ST thereof may receive a first start signal from the first start signal line STL1. The output terminal OUT of the first stage STG1 may be connected to the first scan line SL1 and the start terminal ST of the third stage STG3.

The second stage STG2 may be connected to a second clock line CL2 through the first clock terminal CT1, may be connected to a fourth clock line CL4 through the second clock terminal CT2, and may be connected to a start signal line STL through the start terminal ST. The first clock terminal CT1 of the second stage STG2 may receive a second clock signal from the second clock line CL2, the second clock terminal CT2 thereof may receive a fourth clock signal from the fourth clock line CL4, and the start terminal ST thereof may receive a start signal from the start signal line STL. The output terminal OUT of the second stage STG2 may be connected to the second scan line SL2 and the start terminal ST of the fourth stage STG4.

The start terminal ST of the (2p−1)-th stage STG(2p−1) may be connected to the output terminal OUT of the (2p−3)-th stage STG(2p−3), and the start terminal ST of the 2p-th stage STG(2p) may be connected to the output terminal OUT of the (2p−2)-th stage STG(2p−2). Accordingly, the (2p−1)-th stage STG(2p−1) may receive the scan signal of the (2p−3)-th stage STG(2p−3), and the 2p-th stage STG(2p) may receive the scan signal of the (2p−2)-th stage STG(2p−2). Here, the (2p−1)-th stage STG(2p−1) may be an odd stage that supplies scan signals to the pixels SP arranged in odd rows, and the 2p-th stage STG(2p) may be an even stage that supplies scan signals to the pixels SP arranged in even rows.

The (2p−1)-th stage STG(2p−1) may receive the scan signal of the (2p−3)-th stage STG(2p−3), and may alternately receive the first clock signal and the third clock signal through the first or second clock terminal CT1 or CT2, thereby sequentially outputting scan signals to the pixels arranged in odd rows. The 2p-th stage STG(2p) may receive the scan signal of the (2p−2)-th stage STG(2p−2), and may alternately receive the second clock signal and the fourth clock signal through the first or second clock terminal CT1 or CT2, thereby sequentially outputting scan signals to the pixels arranged in even rows.

When the scan driver 400 receives a start signal having a gate low voltage during the first period t1 and having a gate high voltage during the second period t2 from the start signal line STL, the (2p−1)-th stage STG(2p−1) may supply scan signals to the scan lines SL1, SL3, . . . , SLn−1 in odd rows, and the 2p-th stage STG(2p) may not supply scan signals to the scan lines SL2, SL4, . . . , SLn in even rows.

In one embodiment, for example, where the first and second pixels RP and BP are connected to the same data line DL, the first pixels RP are connected to scan lines in odd rows, and the second pixels BP are connected to the scan lines in even rows, the scan driver 400 may perform a lighting inspection of the first pixels RP among the first and second pixels RP and BP based on the start signal having a gate low voltage only during the first period t1. In such an embodiment, where the first and second pixels RP and BP are connected to the same data line DL, the first pixels RP are connected to scan lines in odd rows, and the second pixels BP are connected to the scan lines in even rows, the scan driver 400 may perform a lighting inspection of the second pixels BP among the first and second pixels RP and BP based on the start signal having a gate low voltage only during the second period t2. Therefore, since the display device 10 includes the plurality of stages STG1 to STGn connected to one start signal line STL to control the timing at which the start signal has a gate low voltage, the light inspection of the pixels in the odd rows or the pixels in the even rows among the pixels SP arranged in the plurality of rows may be selectively performed, thereby sufficiently securing the charging time of the corresponding data line. In such an embodiment of the display device 10, the color mixing between the first pixels RP and the second pixels BP may be prevented, and the reliability of a lighting inspection may be improved.

Figure 17:
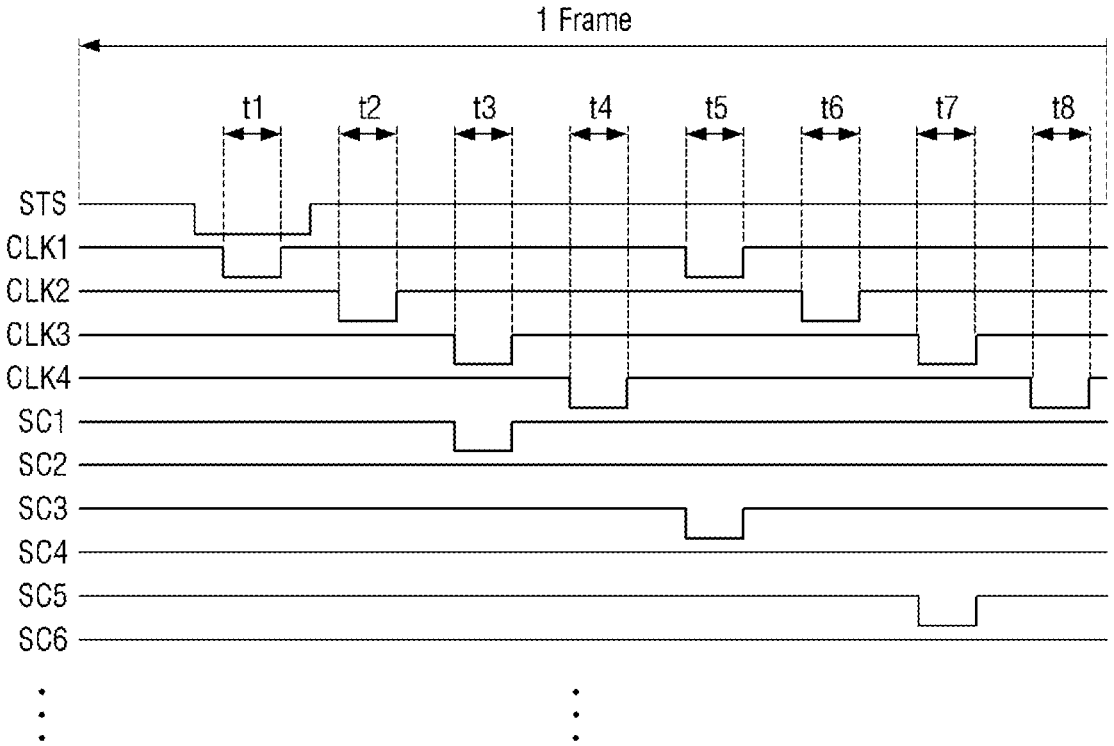
FIG. 17 is a waveform diagram illustrating input/output signals of odd stages in the display device of FIG. 16.

FIG. 17 is a waveform diagram illustrating input/output signals of odd stages in the display device of FIG. 16.

The input/output signals of odd stages of FIG. 17 are substantially the same as the input/output signals of odd stages of FIG. 7 except for a start signal STS. Accordingly, any repetitive detailed description of the same or like elements as those described above with reference to FIG. 7 will hereinafter be omitted or simplified.

Referring to FIG. 17, the start signal STS may be applied to the start terminal ST of the first stage STG1 and the start terminal ST of the second stage STG2. When the lighting inspection of the pixels SP arranged in odd rows is performed, the start signal STS may have a gate low voltage during the first period t1 of one frame and may have a gate high voltage during the second period t2 of one frame. The first stage STG1 may output a first scan signal SC1 based on the start signal STS having a gate low voltage during the first period t1 and the first and third clock signals CLK1 and CLK3. The first scan signal SC1 may be applied to the first scan line SL1 and the start terminal ST of the third stage STG3.

The second stage STG2 may receive a start signal having a gate high voltage during the second period t2, and may not output a second scan signal SC2. Therefore, the pixels SP arranged in even rows may maintain a light-off state.

The third stage STG3 may output a third scan signal SC3 based on the first scan signal SC1 and the first and third clock signals CLK1 and CLK3 of the first stage STG1. The third scan signal SC3 may be applied to the third scan line SL3 and the start terminal ST of the fifth stage STG5.

In such an embodiment, as described above, the (2p−1)-th stage STG(2p−1) may receive the scan signal of the (2p−3)-th stage STG(2p−3), and may alternately receive the first clock signal and the third clock signal through the first or second clock terminal CT1 or CT2, thereby sequentially outputting scan signals to the pixels arranged in odd rows.

In one embodiment, for example, where the first and second pixels RP and BP are connected to a same data line DL, the first pixels RP are connected to scan lines in odd rows, and the second pixels BP are connected to the scan lines in even rows, the scan driver 400 may perform a lighting inspection of the first pixels RP among the first and second pixels RP and BP based on the start signal STS having a gate low voltage during the first period t1. As described above, in an embodiment of the display device 10, the light inspection of the pixels in odd rows among the pixels SP arranged in the plurality of rows may be selectively performed, thereby sufficiently securing the charging time of the corresponding data line. In such an embodiment of the display device 10, when the lighting inspection of the plurality of pixels SP having high resolution is performed, the color mixing between the first pixels RP and the second pixels BP may be effectively prevented, and the reliability of a lighting inspection may be improved.

Figure 18:
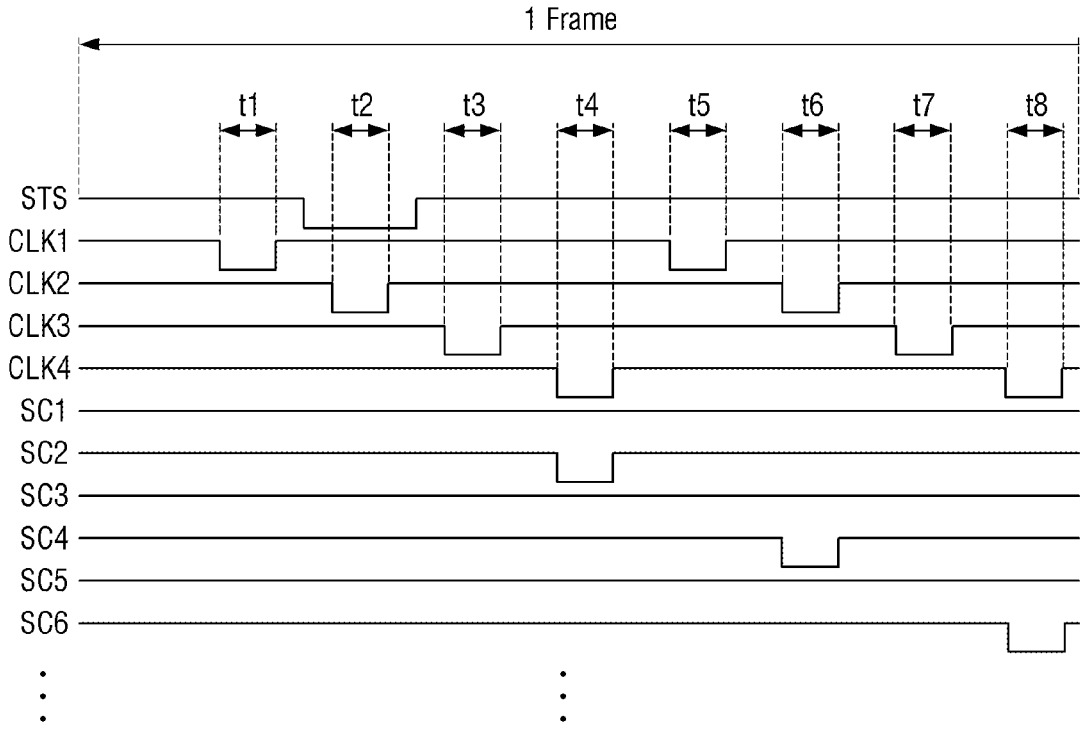
FIG. 18 is a waveform diagram illustrating input/output signals of even stages in the display device of FIG. 16.

FIG. 18 is a waveform diagram illustrating input/output signals of even stages in the display device of FIG. 16.

The input/output signals of even stages of FIG. 18 are substantially the same as the input/output signals of even stages of FIG. 13 except for a start signal STS. Accordingly, any repetitive detailed description of the same or like elements as those described above with reference to FIG. 13 will hereinafter be omitted or simplified.

Referring to FIG. 18, the start signal STS may be applied to the start terminal ST of the first stage STG1 and the start terminal ST of the second stage STG2. When the lighting inspection of the pixels SP arranged in even rows is performed, the start signal STS may have a gate high voltage during the first period t1 of one frame and may have a gate low voltage during the second period t2 of one frame. The second stage STG2 may output a second scan signal SC2 based on the start signal STS having a gate low voltage during the second period t2 and the second and fourth clock signals CLK2 and CLK4. The second scan signal SC2 may be applied to the second scan line SL2 and the start terminal ST of the fourth stage STG4.

The first stage STG1 may receive a start signal having a gate high voltage during the first period t1, and may not output a first scan signal SC1. Therefore, the pixels SP arranged in odd rows may maintain a light-off state.

The fourth stage STG4 may output a fourth scan signal SC4 based on the second scan signal SC2 and the second and fourth clock signals CLK2 and CLK4 of the second stage STG2. The fourth scan signal SC4 may be applied to the fourth scan line SL4 and the start terminal ST of the sixth stage STG6.

As described above, the 2p-th stage STG(2p) may receive the scan signal of the (2p−2)-th stage STG(2p−2), and may alternately receive the second clock signal and the fourth clock signal through the first or second clock terminal CT1 or CT2, thereby sequentially outputting scan signals to the pixels arranged in even rows.

In one embodiment, for example, where the first and second pixels RP and BP are connected to a same data line DL, the first pixels RP are connected to scan lines in odd rows, and the second pixels BP are connected to the scan lines in even rows, the scan driver 400 may perform a lighting inspection of the second pixels BP among the first and second pixels RP and BP based on the start signal STS having a gate low voltage during the second period t2. As described above, in an embodiment of the display device 10, the light inspection of the pixels in even rows among the pixels SP arranged in the plurality of rows may be selectively performed, thereby sufficiently securing the charging time of the corresponding data line. In such an embodiment of the display device 10, when the lighting inspection of the plurality of pixels SP having high resolution is performed, the color mixing between the first pixels RP and the second pixels BP may be effectively prevented, and the reliability of a lighting inspection may be improved.

Figure 19:
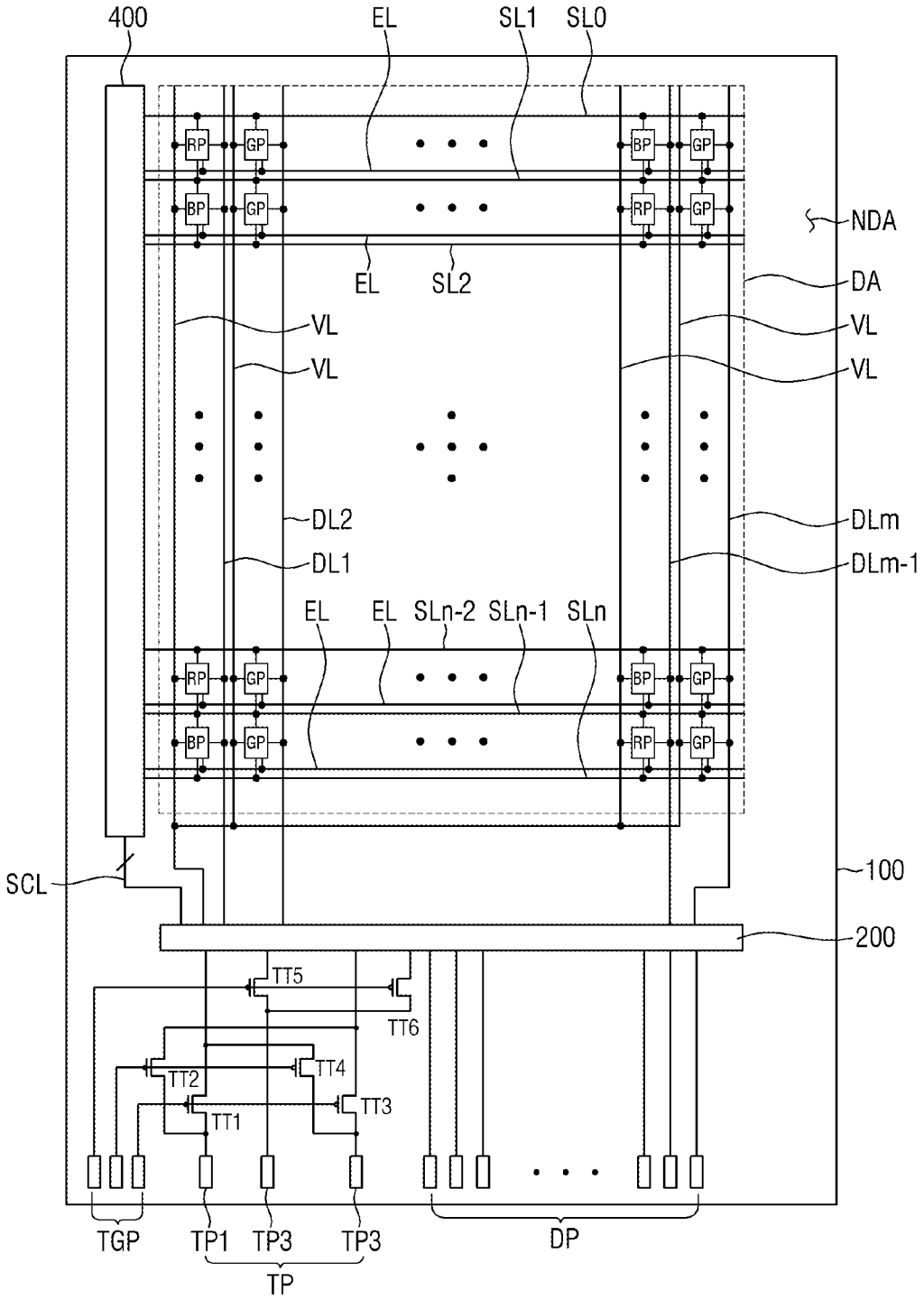
FIG. 19 is a plan view of a display device according to an alternative embodiment.
Figure 20:
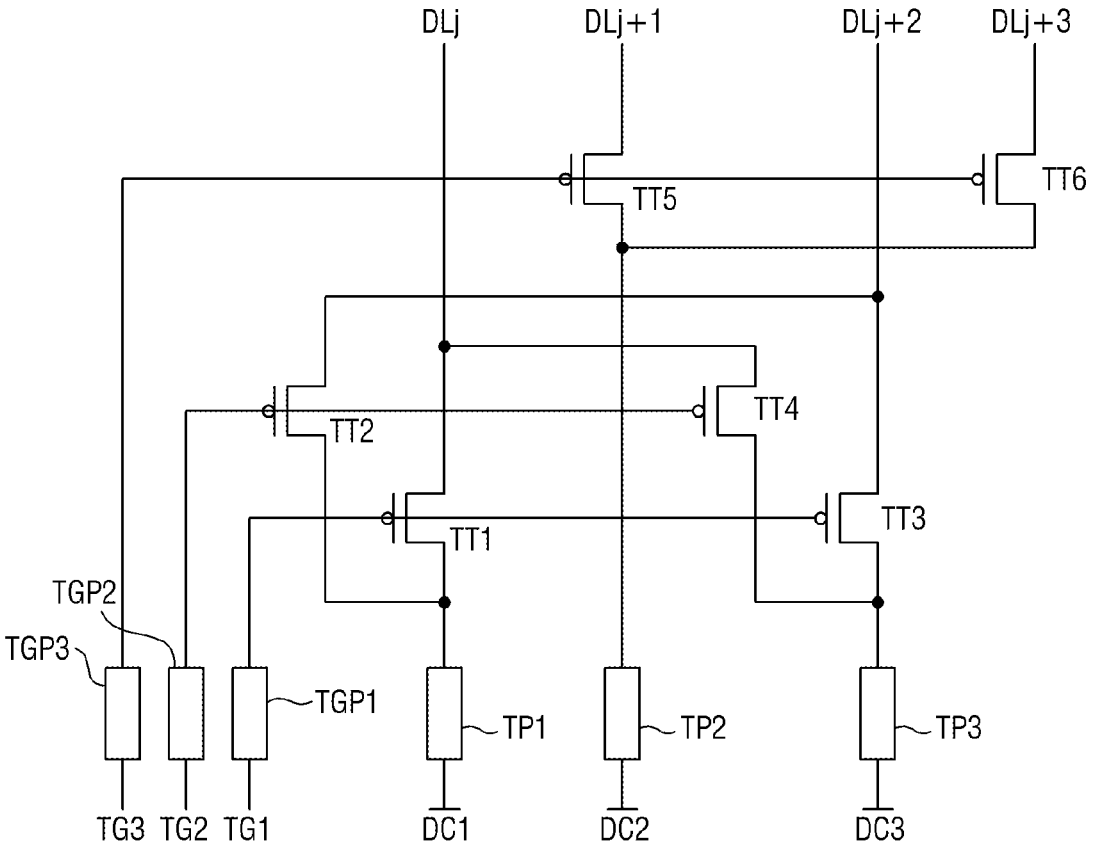
FIG. 20 is a view illustrating a process of supplying a lighting voltage in a display device according to an alternative embodiment.

FIG. 19 is a plan view of a display device according to an alternative embodiment, and FIG. 20 is a view illustrating a process of supplying a lighting voltage in a display device according to an alternative embodiment.

The display device of FIGS. 19 and 20 is substantially the same as the display device of FIGS. 2 and 8 except for test transistors and test gate pads. Accordingly, any repetitive detailed description of the same or like elements as those described above with reference to FIGS. 2 and 8 will hereinafter be omitted or simplified.

Referring to FIGS. 19 and 20, in an embodiment of the display device, the test pads TP may include first to third test pads TP1, TP2, and TP3. The first to third test pads TP1, TP2, and TP3 may receive first to third lighting voltages DC1, DC2, and DC3, respectively. Each of the first to third lighting voltages DC1, DC2, and DC3 may be a gray voltage that turns on the pixels SP or a black voltage that turns off the pixels SP. Each of the first to third lighting voltages DC1, DC2, and DC3 may be a DC voltage, but is not limited thereto. In one embodiment, for example, the first to third test pads TP1, TP2, and TP3 may be connected to a lighting device or a power supply, and may receive the first to third lighting voltages DC1, DC2, and DC3.

The test transistors may include first to sixth test transistors TT1 to TT6. The gate electrode of the first test transistor TT1 may be connected to a first test gate pad TGP1. The first test transistor TT1 may be connected between the first test pad TP1 and the j-th data line DLj. The first test transistor TT1 may selectively supply the first lighting voltage DC1 to the j-th data line DLj based on the first test gate signal TG1 received from the first test gate pad TGP1.

The gate electrode of the second test transistor TT2 may be connected to a second test gate pad TGP2. The second test transistor TT2 may be connected between the first test pad TP1 and the (j+2)-th data line DLj+2. The second test transistor TT2 may selectively supply the first lighting voltage DC1 to the (j+2)-th data line DLj+2 based on the second test gate signal TG2 received from the second test gate pad TGP2.

The gate electrode of the third test transistor TT3 may be connected to a first test gate pad TGP1. The third test transistor TT3 may be connected between the third test pad TP3 and the (j+2)-th data line DLj+2. The third test transistor TT3 may selectively supply the third lighting voltage DC3 to the (j+2)-th data line DLj+2 based on the first test gate signal TG2 received from the first test gate pad TGP1.

The gate electrode of the fourth test transistor TT4 may be connected to a second test gate pad TGP2. The fourth test transistor TT4 may be connected between the third test pad TP3 and the j-th data line DLj. The fourth test transistor TT4 may selectively supply the third lighting voltage DC3 to the j-th data line DLj based on the second test gate signal TG2 received from the second test gate pad TGP2.

The gate electrode of each of the fifth and sixth test transistors TT5 and TT6 may be connected to a third test gate pad TGP3. The fifth test transistor TT5 may be connected between the second test pad TP2 and the (j+1)-th data line DLj+1, and the sixth test transistor TT6 may be connected between the second test pad TP2 and the (j+3)-th data line DLj+3. The fifth test transistor TT5 may selectively supply the second lighting voltage DC2 to the (j+1)-th data line DLj+1 based on the third test gate signal TG3 received from the third test gate pad TGP3. The sixth test transistor TT6 may selectively supply the second lighting voltage DC2 to the (j+3)-th data line DLj+3 based on the third test gate signal TG3 received from the third test gate pad TGP3.

Each of the first to sixth test transistors TT1 to TT6 may be connected between a corresponding test pad of the test pads TP and a corresponding data line DL of the plurality of data lines DL, thereby selectively supplying the first to third lighting voltages DC1, DC2, and DC3 to the plurality of data lines DL.

The first to third test gate pads TGP1, TGP2, and TGP3 may receive the first to third test gate signals TG1, TG2, and TG3, respectively. Each of the first to third test gate pads TGP1, TGP2, and TGP3 may be connected to a gate electrode of at least one transistor selected from the first to sixth test transistors TT1 to TT6. In one embodiment, for example, the test gate pad TGP may be connected to a lighting device, and may receive test gate signals that turn on the first to sixth test transistors TT1 to TT6 from the lighting device.

Figure 21:
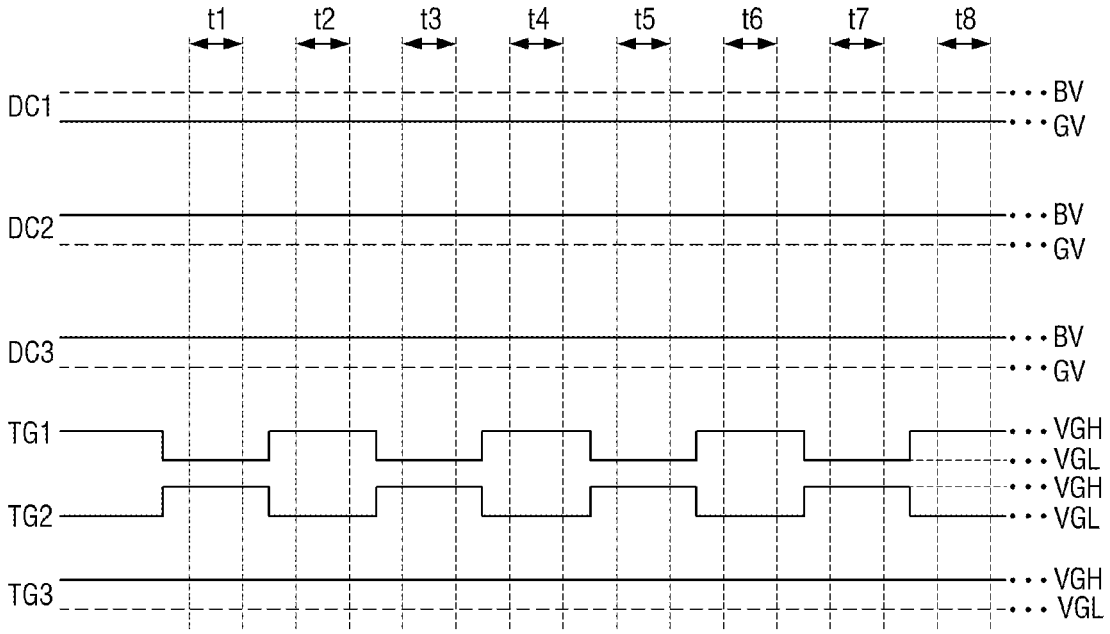
FIG. 21 is a waveform diagram illustrating a lighting voltage and a test gate signal in a display device according to an embodiment.

FIG. 21 is a waveform diagram illustrating a lighting voltage and a test gate signal in a display device according to an embodiment.

Referring to FIG. 21, in an embodiment of the display device 10, the lighting inspection of some pixels among the plurality of pixels SP may be performed. In an embodiment of the display device 10, the first to third lighting voltages DC1, DC2, and DC3 may be supplied through the first to third test pads TP1, TP2, and TP3, and the first to third test gate signal TG1, TG2, and TG3 may be supplied through the first to third test gate pads TGP1, TGP2, and TGP3.

The first lighting voltage DC1 may maintain a gray voltage GV that turns on the pixels SP during one frame or during the first to eighth periods t1 to t8. The second and third lighting voltages DC2 and DC3 may maintain a black voltage BV that turns off the pixels SP during one frame or during the first to eighth periods t1 to t8. When the pixels SP receive the gray voltage GV from the data line DL, these pixels SP may be turned on, and when the pixels SP receive the black voltage BV from the data line DL, these pixels SP may be turned off.

The first test gate signal TG1 may maintain a gate low voltage VGL during the first period t1, the third period t3, the fifth period t5, and the seventh period t7, and may maintain a gate high voltage VGH during the second period t2, the fourth period t4, the sixth period t6, and the eighth period t8. The second test gate signal TG2 may maintain a gate high voltage VGH during the first period t1, the third period t3, the fifth period t5, and the seventh period t7, and may maintain a gate low voltage VGL during the second period t2, the fourth period t4, the sixth period t6, and the eighth period t8.

Referring to FIGS. 10, 17, 20, and 21, when the lighting inspection of the first pixels RP among the first and second pixels RP and BP connected to the first data line DL1 or the j-th data line DLj is performed, the start signal STS may have a gate low voltage VGL during the first period t1 of one frame, and may have a gate high voltage VGH during the second period t2 of one frame. The (2p−1)-th stage STG (2p−1) may supply scan signals SC1, SC3, SC5, . . . to the scan lines SL1, SL3, SL5, . . . in odd rows, and the 2p-th stage STG(2p) may not output scan signals. The first lighting voltage DC1 may maintain a gray voltage GV during one frame, and the second and third lighting voltages DC2 and DC3 may maintain a black voltage BV during one frame. Accordingly, among the first and second pixels RP and BP connected to the first data line DL1 or the j-th data line DLj, the first pixels RP connected to the scan lines SL1, SL3, SL5, . . . in odd rows, may be turned on, and the second pixels BP connected to the scan lines SL2, SL4, SL6, . . . in even rows may be turned off. In one embodiment, for example, in the display device 10, the charging time of the first data line DL1 may be sufficiently secured by turning on the first pixel RP connected to the third scan line SL3 without turning on the second pixel BP connected to the second scan line SL2 after turning on the first pixel RP connected to the first data line DL1 and the first scan line SL1. In such an embodiment of the display device 10, the color mixing between the first pixels RP and the second pixels BP may be effectively prevented, and the reliability of a lighting inspection may be improved.

In an alternative embodiment, where the display device 10 includes the configuration of the first start signal STS1 of FIG. 7 instead of the configuration of the start signal STS of FIG. 17, the lighting inspection result of FIG. 10 may be obtained.

Referring to FIGS. 14, 18, 20, and 21, when the lighting inspection of the second pixels BP among the first and second pixels RP and BP connected to the first data line DL1 or the j-th data line DLj is performed, the start signal STS may have a gate high voltage VGH during the first period t1 of one frame, and may have a gate low voltage VGL during the second period t2 of one frame. The 2p-th stage STG(2p) may supply scan signals SC2, SC4, SC6, . . . to the scan lines SL2, SL4, SL6, . . . in even rows, and the (2p−1)-th stage STG(2p−1) may not output scan signals. The first lighting voltage DC1 may maintain a gray voltage GV during one frame, and the second and third lighting voltages DC2 and DC3 may maintain a black voltage BV during one frame. Accordingly, among the first and second pixels RP and BP connected to the first data line DL1 or the j-th data line DLj, the second pixels BP connected to the scan lines SL2, SL4, SL6, . . . in even rows, may be turned on, and the first pixels RP connected to the scan lines SL1, SL3, SL5, . . . in odd rows may be turned off. In one embodiment, for example, in the display device 10, the charging time of the first data line DL1 may be sufficiently secured by turning on the second pixel BP connected to the fourth scan line SL4 without turning on the first pixel RP connected to the third scan line SL3 after turning on the second pixel BP connected to the first data line DL1 and the second scan line SL2. In such an embodiment of the display device 10, the color mixing between the first pixels RP and the second pixels BP may be effectively prevented, and the reliability of a lighting inspection may be improved.

In an alternative embodiment, where the display device 10 includes the configuration of the second start signal STS2 of FIG. 13 instead of the configuration of the start signal STS of FIG. 18, the lighting inspection result of FIG. 14 may be obtained.

Figure 22:
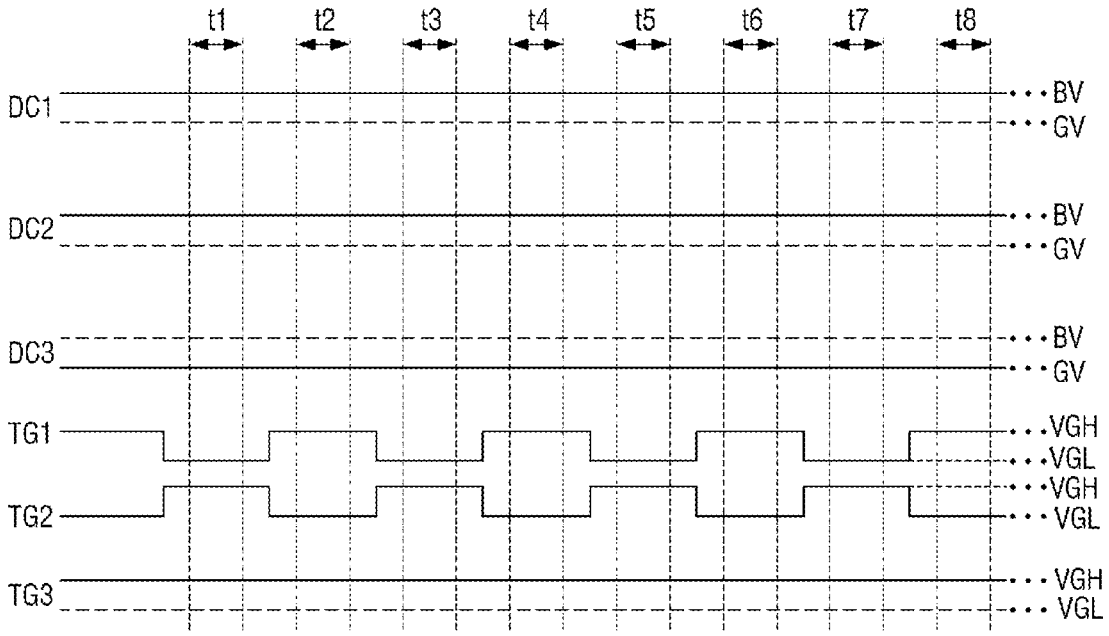
FIG. 22 is a waveform diagram illustrating a lighting voltage and a test gate signal in a display device according to an alternative embodiment.

FIG. 22 is a waveform diagram illustrating another example of a lighting voltage and a test gate signal in a display device according to an alternative embodiment.

Referring to FIG. 22, in an embodiment of the display device 10, the lighting inspection of some pixels among the plurality of pixels SP may be performed. In the display device 10, the first to third lighting voltages DC1, DC2, and DC3 may be supplied through the first to third test pads TP1, TP2, and TP3, and the first to third test gate signal TG1, TG2, and TG3 may be supplied through the first to third test gate pads TGP1, TGP2, and TGP3.

The first and second lighting voltages DC1 and DC2 may maintain a black voltage BV that turns off the pixels SP during one frame or during the first to eighth periods t1 to t8. The third lighting voltage DC3 may maintain a gray voltage GV that turns on the pixels SP during one frame or during the first to eighth periods t1 to t8. When the pixels SP receive the gray voltage GV from the data line DL, these pixels SP may be turned on, and when the pixels SP receive the black voltage BV from the data line DL, these pixels SP may be turned off.

The first test gate signal TG1 may maintain a gate low voltage VGL during the first period t1, the third period t3, the fifth period t5, and the seventh period t7, and may maintain a gate high voltage VGH during the second period t2, the fourth period t4, the sixth period t6, and the eighth period t8. The second test gate signal TG2 may maintain a gate high voltage VGH during the first period t1, the third period t3, the fifth period t5, and the seventh period t7, and may maintain a gate low voltage VGL during the second period t2, the fourth period t4, the sixth period t6, and the eighth period t8.

Referring to FIGS. 12, 17, 20, and 21, when the lighting inspection of the second pixels BP among the first and second pixels RP and BP connected to the third data line DL3 or the (j+2)-th data line DLj+2 is performed, the start signal STS may have a gate low voltage VGL during the first period t1 of one frame, and may have a gate high voltage VGH during the second period t2 of one frame. The (2p−1)-th stage STG(2p−1) may supply scan signals SC1, SC3, SC5, . . . to the scan lines SL1, SL3, SL5, . . . in odd rows, and the 2p-th stage STG(2p) may not output scan signals. The first and second lighting voltage DC1 and DC2 may maintain a black voltage BV during one frame, and the third lighting voltage DC3 may maintain a gray voltage GV during one frame. Accordingly, among the first and second pixels RP and BP connected to the third data line DL3 or the (j+2)-th data line DLj+2, the second pixels BP connected to the scan lines SL1, SL3, SL5, . . . in odd rows, may be turned on, and the first pixels RP connected to the scan lines SL2, SL4, SL6, . . . in even rows may be turned off. In one embodiment, for example, in the display device 10, the charging time of the third data line DL3 may be sufficiently secured by turning on the second pixel BP connected to the third scan line SL3 without turning on the first pixel RP connected to the second scan line SL2 after turning on the second pixel BP connected to the third data line DL3 and the first scan line SL1. In such an embodiment of the display device 10, the color mixing between the first pixels RP and the second pixels BP may be effectively prevented, and the reliability of a lighting inspection may be improved.

In an alternative embodiment, where the display device 10 includes the configuration of the first start signal STS1 of FIG. 7 instead of the configuration of the start signal STS of FIG. 17, the lighting inspection result of FIG. 10 may be obtained.

Referring to FIGS. 15, 18, 20, and 21, when the lighting inspection of the first pixels RP among the first and second pixels RP and BP connected to the third data line DL3 or the (j+2)-th data line DLj+2 is performed, the start signal STS may have a gate high voltage VGH during the first period t1 of one frame, and may have a gate low voltage VGL during the second period t2 of one frame. The 2p-th stage STG(2p) may supply scan signals SC2, SC4, SC6, . . . to the scan lines SL2, SL4, SL6, . . . in even rows, and the (2p−1)-th stage STG(2p−1) may not output scan signals. The first and second lighting voltage DC1 and DC2 may maintain a black voltage BV during one frame, and the third lighting voltage DC3 may maintain a gray voltage GV during one frame. Accordingly, among the first and second pixels RP and BP connected to the third data line DL3 or the (j+2)-th data line DLj+2, the first pixels RP connected to the scan lines SL2, SL4, SL6, in even rows may be turned on, and the second pixels BP connected to the scan lines SL1, SL3, SL5, . . . in odd rows may be turned off. In one embodiment, for example, in the display device 10, the charging time of the third data line DL3 may be sufficiently secured by turning on the first pixel RP connected to the fourth scan line SL4 without turning on the second pixel BP connected to the third scan line SL3 after turning on the first pixel RP connected to the third data line DL3 and the second scan line SL2. In such an embodiment the display device 10, the color mixing between the first pixels RP and the second pixels BP may be effectively prevented, and the reliability of a lighting inspection may be improved.

In an alternative embodiment, where the display device 10 includes the configuration of the second start signal STS2 of FIG. 13 instead of the configuration of the start signal STS of FIG. 18, the lighting inspection result of FIG. 14 may be obtained.

According to embodiments of a display device, as described herein, the display device may include first pixels and second pixels connected to a same data line to emit light of different colors from each other, and a scan driver which supplies a scan signal to one of the first pixels and the second pixels. When a lighting voltage is supplied to the data line, the display device may supply the lighting voltage to one of the first pixels and the second pixels, and sufficiently secure the charging time of the data line. Therefore, the display device may effectively prevent the color mixing between the first pixels and the second pixels, and may improve the reliability of a lighting inspection of the first pixels and the second pixels.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device, comprising:

a plurality of first pixels connected to a plurality of first scan lines and including a first pixel connected to a first data line and a fourth pixel connected to a third data line;

a plurality of second pixels connected to a plurality of second scan lines and including a second pixel connected to the first data and a fifth pixel connected to the third data line;

a plurality of third pixels connected to the first scan lines or the second scan lines and including a third pixel connected to a second data line;

a scan driver including a first scan driving circuit and a second scan driving circuit disposed opposite to each other;

a first test transistor which supplies a first lighting voltage to the list data line based on a first test gate signal;

a second test transistor which supplies the first lighting voltage to the third data line based on a second test gate signal; and a third test transistor which supplies a third lighting voltage to the third data line based on the first test gate signal, wherein each of the first scan driving circuit and the second scan driving circuit comprises:

a plurality of first stages connected to the first scan lines and a first start signal line, wherein the plurality of first stages supplies a plurality of first scan signals to the first scan lines, the plurality of first scan signals including a first on-period having a first voltage to turn on first transistors connected to the first scan lines and a first off-period having a second voltage to turn off the first transistors; and a plurality of second stages connected to the second scan lines and a second start signal line different from the first start signal line, wherein the plurality of second stages are not connected to the first scan lines and supplies a plurality of second scan signals to the second scan lines, the plurality of second scan signals including a second on-period having a third voltage to turn on second transistors connected to the second scan lines and a second off-period having a fourth voltage to turn off the fourth transistors, wherein the first on-period of the first scan signals from the first stages and the second on-period of the second scan signals from the second stages do not overlap each other, and output terminals of the second stages are not connected to output terminals of the first stages.

2. The display device of claim 1, wherein the first stages sequentially supply the first scan signals to each of the first scan lines based on a first start signal applied thereto through the first start signal line; and the second stages sequentially supply the second scan signals to each of the second scan lines based on a second start signal applied thereto through the second start signal line.

3. The display device of claim 2, wherein the first stages comprise:

a first-first stage which outputs a first-first scan signal based on the first start signal; and a second-first stage which outputs a second-first scan signal based on the first-first scan signal.

4. The display device of claim 2, wherein the second stages comprise:

a first-second stage which outputs a first-second scan signal based on the second start signal; and a second-second stage which outputs a second-second scan signal based on the first-second scan signal.

5. The display device of claim 2, further comprising:

a first test transistor which supplies a first lighting voltage to the first data line based on a test gate signal; and a second test transistor which supplies a second lighting voltage to the second data line based on the test gate signal.

6. The display device of claim 5, wherein, when the first lighting voltage has a first voltage level which turns on the first pixels or the second pixels, the second lighting voltage has a second voltage level which turns off the plurality of first pixels or the plurality of second pixels.

7. The display device of claim 2, wherein the third pixels further include a sixth pixel connected to a fourth data line.

8. The display device of claim 7, further comprising:

a fourth test transistor which supplies the third lighting voltage to the first data line based on the second test gate signal.

9. The display device of claim 8, wherein, when the first lighting voltage has a first voltage level which turns on the first pixels or the plurality of second pixels, the third lighting voltage has a second voltage level which turns off the first pixels or the second pixels.

10. The display device of claim 8, wherein, when the third lighting voltage has a first voltage level which turns on the first pixels or the second pixels, the first lighting voltage has a second voltage level which turns off the first pixels or the second pixels.

11. The display device of claim 7, further comprising:

a fifth test transistor which supplies a second lighting voltage to the second data line based on a third test gate signal; and a sixth test transistor which supplies the second lighting voltage to the fourth data line based on the third test gate signal.

12. The display device of claim 1, wherein the first stages sequentially supply the first scan signals to each of the first scan lines when a start signal is supplied thereto through the first start signal line during a first period; and the second stages sequentially supply the second scan signals to each of the second scan lines when the start signal is supplied thereto through the second start signal line during a second period different from the first period.

13. The display device of claim 12, wherein the first stages comprise:

a first-first stage which outputs a first-first scan signal when the start signal is supplied during the first period; and a second-first stage which outputs a second-first scan signal based on the first-first scan signal.

14. The display device of claim 12, wherein the second stages comprise:

a first-second stage which outputs a first-second scan signal when the start signal is supplied during the second period; and a second-second stage which outputs a second-second scan signal based on the first-second scan signal.

15. The display device of claim 12, wherein the third pixels further include a sixth pixel connected to a fourth data line.

16. The display device of claim 15, further comprising:

a fourth test transistor which supplies the third lighting voltage to the first data line based on the second test gate signal.

17. The display device of claim 16, wherein, when the first lighting voltage has a first voltage level which turns on the first pixels or the second pixels, the third lighting voltage has a second voltage level which turns off the first pixels or the second pixels.

18. The display device of claim 15, further comprising:

a fifth test transistor which supplies a second lighting voltage to the second data line based on a third test gate signal; and a sixth test transistor which supplies the second lighting voltage to the fourth data line based on the third test gate signal.

* * * * *